US011225079B2

(12) United States Patent
Hirata et al.

(10) Patent No.: US 11,225,079 B2
(45) Date of Patent: Jan. 18, 2022

(54) HEAD CHIP, LIQUID JET HEAD, AND LIQUID JET RECORDING DEVICE

(71) Applicant: SII PRINTEK INC., Chiba (JP)

(72) Inventors: Masakazu Hirata, Chiba (JP); Kenji Suzuki, Chiba (JP); Masanori Tamura, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 17/105,067

(22) Filed: Nov. 25, 2020

(65) Prior Publication Data

US 2021/0162756 A1 Jun. 3, 2021

(30) Foreign Application Priority Data

Nov. 28, 2019 (JP) ..... JP2019-215363

(51) Int. Cl.
*B41J 2/14* (2006.01)
*B41J 2/145* (2006.01)

(52) U.S. Cl.
CPC ..... *B41J 2/1433* (2013.01); *B41J 2/145* (2013.01); *B41J 2002/14411* (2013.01); *B41J 2002/14467* (2013.01)

(58) Field of Classification Search
CPC ..... B41J 2/1433; B41J 2/145; B41J 2002/14411; B41J 2002/14467;
(Continued)

(56) References Cited

U.S. PATENT DOCUMENTS

2015/0266292 A1 9/2015 Yoshida
2020/0101733 A1* 4/2020 Hagiwara ..... B41J 2/14233
2021/0162757 A1* 6/2021 Hirata ..... B41J 2/14201

FOREIGN PATENT DOCUMENTS

EP 2363291 A1 9/2011
JP 2015-178209 A 10/2015

OTHER PUBLICATIONS

Extended European Search Report in Europe Application No. 20210390.9, dated Apr. 15, 2021, 10 pages.

* cited by examiner

*Primary Examiner* — Lamson D Nguyen
(74) *Attorney, Agent, or Firm* — Crowell & Moring LLP

(57) ABSTRACT

There are provided a head chip and so on capable of improving the print image quality while suppressing the manufacturing cost. The head chip according to an embodiment of the present disclosure includes an actuator plate having a plurality of ejection grooves, a nozzle plate having a plurality of nozzle holes, and a cover plate having a first through hole, a second through hole, and a wall part. The plurality of nozzle holes includes a plurality of first nozzle holes arranged so as to be shifted toward the first through hole, and a plurality of second nozzle holes arranged so as to be shifted toward the second through hole. In a first ejection groove communicated with the first nozzle hole, a first cross-sectional area of a part communicated with the first through hole is smaller than a second cross-sectional area of a part communicated with the second through hole. In a second ejection groove communicated with the second nozzle hole, the second cross-sectional area is smaller than the first cross-sectional area. A first expansion flow channel part is formed in the vicinity of the first nozzle hole, and a second expansion flow channel part is formed in the vicinity of the second nozzle hole. A central position of the first expansion flow channel part coincides with a first central position of the first nozzle hole, or is shifted toward the first through hole. A central position of the second expansion flow channel part coincides with a second central position of the second nozzle hole, or is shifted toward the second through hole.

8 Claims, 21 Drawing Sheets

(58) Field of Classification Search
CPC ..... B41J 2002/14491; B41J 2202/11; B41J 2202/12; B41J 2/14209
See application file for complete search history.

EMBODIMENT

COMPARATIVE EXAMPLE 3

EMBODIMENT

COMPARATIVE EXAMPLE 4

Sout1 ← (Sfout1<Sfin1)

→ Sin1

COMPARATIVE EXAMPLE 1

COMPARATIVE EXAMPLE 1

COMPARATIVE EXAMPLE 2

COMPARATIVE EXAMPLE 2

MODIFIED EXAMPLE 1
Pn11
(431a) H31
Ph31
4a (41a)
415
411
H11

EMBODIMENT
(431) H31
Ph31
4 (41)
415
411
H11

COMPARATIVE EXAMPLE 3
(301) H31
Ph31
304 (300)
415
411
H11
Sout1
Sin1
(Sfin1<Sfout1)
Z
X
Y

MODIFIED EXAMPLE 1

EMBODIMENT

COMPARATIVE EXAMPLE 4

MODIFIED EXAMPLE 2

MODIFIED EXAMPLE 2

MODIFIED EXAMPLE 3

MODIFIED EXAMPLE 3

MODIFIED EXAMPLE 4

MODIFIED EXAMPLE 4

HEAD CHIP, LIQUID JET HEAD, AND LIQUID JET RECORDING DEVICE

RELATED APPLICATIONS

This application claims priority to Japanese Patent Application No. 2019-215363, filed on Nov. 28, 2019, the entire content of which is incorporated herein by reference.

BACKGROUND OF THE INVENTION

1. Field of the Invention

The present disclosure relates to a head chip, a liquid jet head and a liquid jet recording device.

2. Description of the Related Art

Liquid jet recording devices equipped with liquid jet heads are used in a variety of fields, and a variety of types of liquid jet heads have been developed (see, e.g., JP-A-2015-178209).

Further, such a liquid jet head is provided with a head chip for jetting ink (liquid).

In such a head chip or the like, in general, it is required to suppress the manufacturing cost and to improve print image quality. It is desirable to provide a head chip, a liquid jet head, and a liquid jet recording device capable of improving the print image quality while suppressing the manufacturing cost.

SUMMARY OF THE INVENTION

The head chip according to an embodiment of the present disclosure includes an actuator plate having a plurality of ejection grooves arranged side by side along a predetermined direction, a nozzle plate having a plurality of nozzle holes individually communicated with the plurality of ejection grooves, and a cover plate having a first through hole configured to make the liquid inflow into the ejection groove, a second through hole configured to make the liquid outflow from the ejection groove, and a wall part configured to cover the ejection groove. The plurality of nozzle holes includes a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove. In a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, and in a second ejection groove as the ejection groove communicated with the second nozzle hole, the second cross-sectional area is smaller than the first cross-sectional area. A first expansion flow channel part configured to increase a third cross-sectional area as a cross-sectional area of a flow channel of the liquid in a vicinity of the first nozzle hole is formed in the vicinity of the first nozzle hole, and a second expansion flow channel part configured to increase a fourth cross-sectional area as a cross-sectional area of a flow channel of the liquid in a vicinity of the second nozzle hole is formed in the vicinity of the second nozzle hole. A central position along the extending direction of the ejection groove in the first expansion flow channel part coincides with a first central position as a central position of the first nozzle hole, or is shifted toward the first through hole along the extending direction of the ejection groove from the first central position, and a central position along the extending direction of the ejection groove in the second expansion flow channel part coincides with a second central position as a central position of the second nozzle hole, or is shifted toward the second through hole along the extending direction of the ejection groove from the second central position.

The liquid jet head according to an embodiment of the present disclosure includes the head chip according to the embodiment of the present disclosure.

The liquid jet recording device according to an embodiment of the present disclosure includes the liquid jet head according to the embodiment of the present disclosure.

According to the head chip, the liquid jet head, and the liquid jet recording device according to an embodiment of the present disclosure, it becomes possible to improve the print image quality while suppressing the manufacturing cost.

BRIEF DESCRIPTION OF THE DRAWINGS

FIGS. 7A and 7B are schematic cross-sectional views showing an example of a positional relationship of a nozzle hole and an expansion flow channel part related to an embodiment and so on.

FIGS. 8A and 8B are schematic cross-sectional views showing another example of the positional relationship of the nozzle hole and the expansion flow channel part related to the embodiment and so on.

FIGS. 13A, 13B and 13C are schematic cross-sectional views showing an example of a positional relationship of a nozzle hole and an expansion flow channel part related to Modified Example 1 and so on.

FIGS. 14A, 14B and 14C are schematic cross-sectional views showing another example of the positional relationship of the nozzle hole and the expansion flow channel part related to Modified Example 1 and so on.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example when an expansion flow channel part is provided to an alignment plate)
2. Modified Examples Modified Example 1 (an example when a central position of the expansion flow channel part coincides with a central position of a nozzle hole)

Modified Example 2 (an example when one end part of the expansion flow channel part is expanded outside a pump chamber)

Modified Example 3 (an example when the expansion flow channel part is provided to a nozzle plate)

Modified Example 4 (an example when the expansion flow channel part is provided to an actuator plate)

3. Other Modified Examples

1. Embodiment

[A. Overall Configuration of Printer 1]

Figure 1:
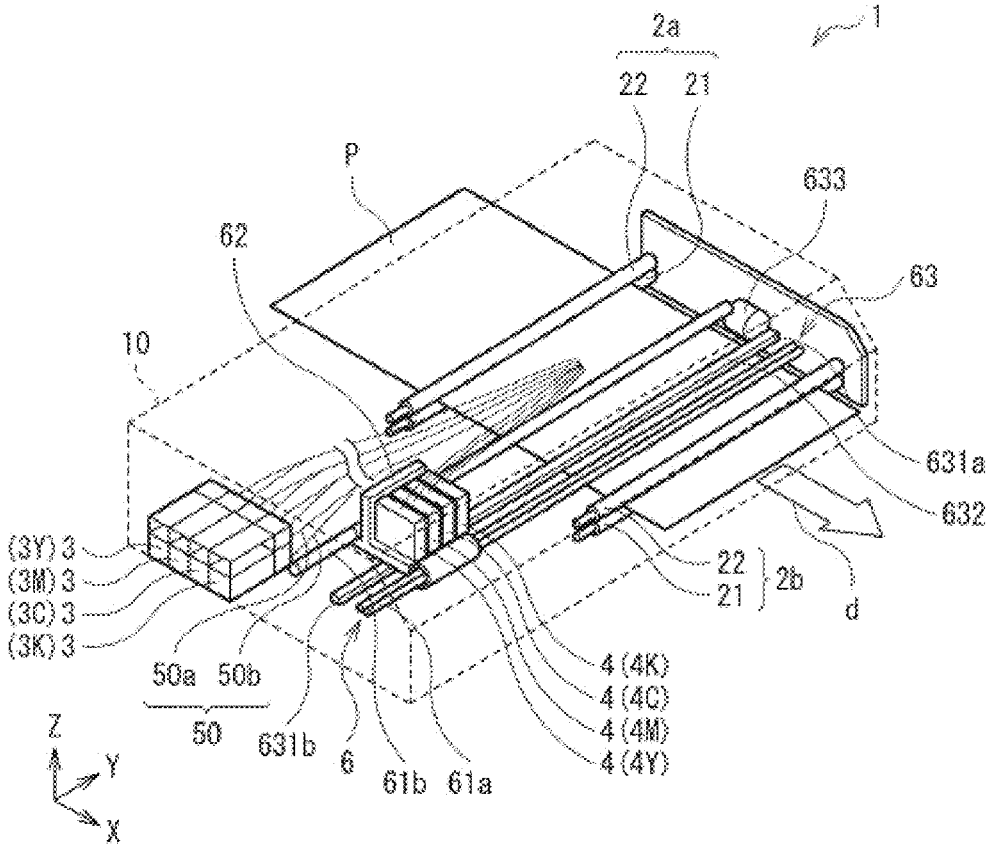
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink 9 described later. It should be noted that the recording target medium is not limited to paper, but includes a material on which recording can be performed such as ceramic or glass.

As shown in FIG. 1, the printer 1 is provided with a pair of carrying mechanisms 2*a*, 2*b*, ink tanks 3, inkjet heads 4, circulation channels 50, and a scanning mechanism 6. These members are housed in a chassis 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4K described later) each correspond to a specific example of a "liquid jet head" in the present disclosure. Further, the ink 9 corresponds to a specific example of the "liquid" in the present disclosure.

The carrying mechanisms 2*a*, 2*b* are each a mechanism for carrying the recording paper P along a carrying direction d (an X-axis direction) as shown in FIG. 1. These carrying mechanisms 2*a*, 2*b* each have a grit roller 21, a pinch roller 22, and a drive mechanism (not shown). This drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are provided four types of tanks for individually containing four colors of ink 9, namely yellow (Y), magenta (M), cyan (C), and black (K), in this example as shown in FIG. 1. Specifically, there are disposed the ink tank 3Y for containing the ink 9 having a yellow color, the ink tank 3M for containing the ink 9 having a magenta color, the ink tank 3C for containing the ink 9 having a cyan color, and the ink tank 3K for containing the ink 9 having a black color. These ink tanks 3Y, 3M, 3C, and 3K are arranged side by side along the X-axis direction inside the chassis 10.

It should be noted that the ink tanks 3Y, 3M, 3C, and 3K have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording (printing) of images, characters, and so on. As the inkjet heads 4, there are also disposed four types of heads for individually jetting the four colors of ink 9 respectively contained in the ink tanks 3Y, 3M, 3C, and 3K described above in this example as shown in FIG. 1. Specifically, there are disposed the inkjet head 4Y for jetting the ink 9 having a yellow color, the inkjet head 4M for jetting the ink 9 having a magenta color, the inkjet head 4C for jetting the ink 9 having a cyan color, and the inkjet head 4K for jetting the ink 9 having a black color. These inkjet heads 4Y, 4M, 4C and 4K are arranged side by side along the Y-axis direction inside the chassis 10.

It should be noted that the inkjet heads 4Y, 4M, 4C and 4K have the same configuration except the color of the ink 9 used therein, and are therefore collectively referred to as inkjet heads 4 in the following description. Further, the detailed configuration example of the inkjet heads 4 will be described later (FIG. 2 through FIG. 6).

(Circulation Flow Channels 50)

As shown in FIG. 1, the circulation channels 50 each have flow channels 50*a*, 50*b*. The flow channel 50*a* is a flow channel of a part extending from the ink tank 3 to the inkjet head 4 via a liquid feeding pump (not shown). The flow channel 50*b* is a flow channel of a part extending from the inkjet head 4 to the ink tank 3 via the liquid feeding pump (not shown). In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3.

In such a manner, in the present embodiment, it is arranged that the ink 9 is circulated between the inside of the ink tank 3 and the inside of the inkjet head 4. It should be noted that these flow channels 50*a*, 50*b* (supply tubes of the ink 9) are each formed of, for example, a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction.

The drive mechanism 63 has a pair of pulleys 631*a*, 631*b* disposed between the guide rails 61*a*, 61*b*, an endless belt 632 wound between these pulleys 631*a*, 631*b*, and a drive motor 633 for rotationally driving the pulley 631*a*. Further, on the carriage 62, there are arranged the four types of inkjet heads 4Y, 4M, 4C and 4K described above side by side along the Y-axis direction.

It is arranged that such a scanning mechanism 6 and the carrying mechanisms 2*a*, 2*b* described above constitute a moving mechanism for moving the inkjet heads 4 and the recording paper P relatively to each other. It should be noted that the moving mechanism of such a method is not a limitation, and it is also possible to adopt, for example, a method (a so-called "single-pass method") of moving only the recording target medium (the recording paper P) while fixing the inkjet heads 4 to thereby move the inkjet heads 4 and the recording target medium relatively to each other.

[B. Detailed Configuration of Inkjet Heads 4]

Subsequently, the detailed configuration example of the inkjet heads 4 (head chips 41) will be described with reference to FIG. 2 through FIG. 6, in addition to FIG. 1.

Figure 2:
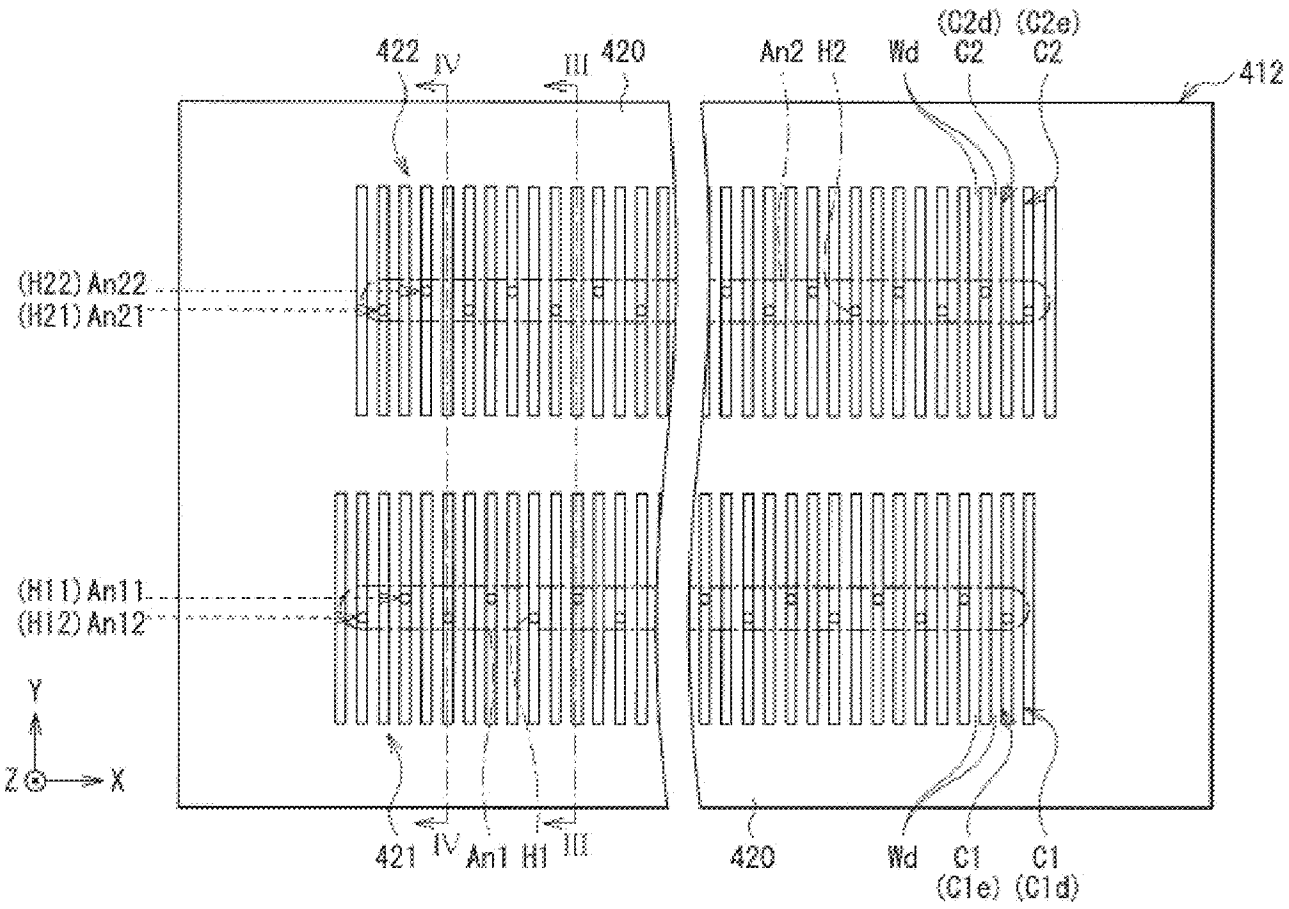
FIG. 2 is a schematic bottom view showing a configuration example of a liquid jet head in the state in which a nozzle plate is detached.
Figure 3:
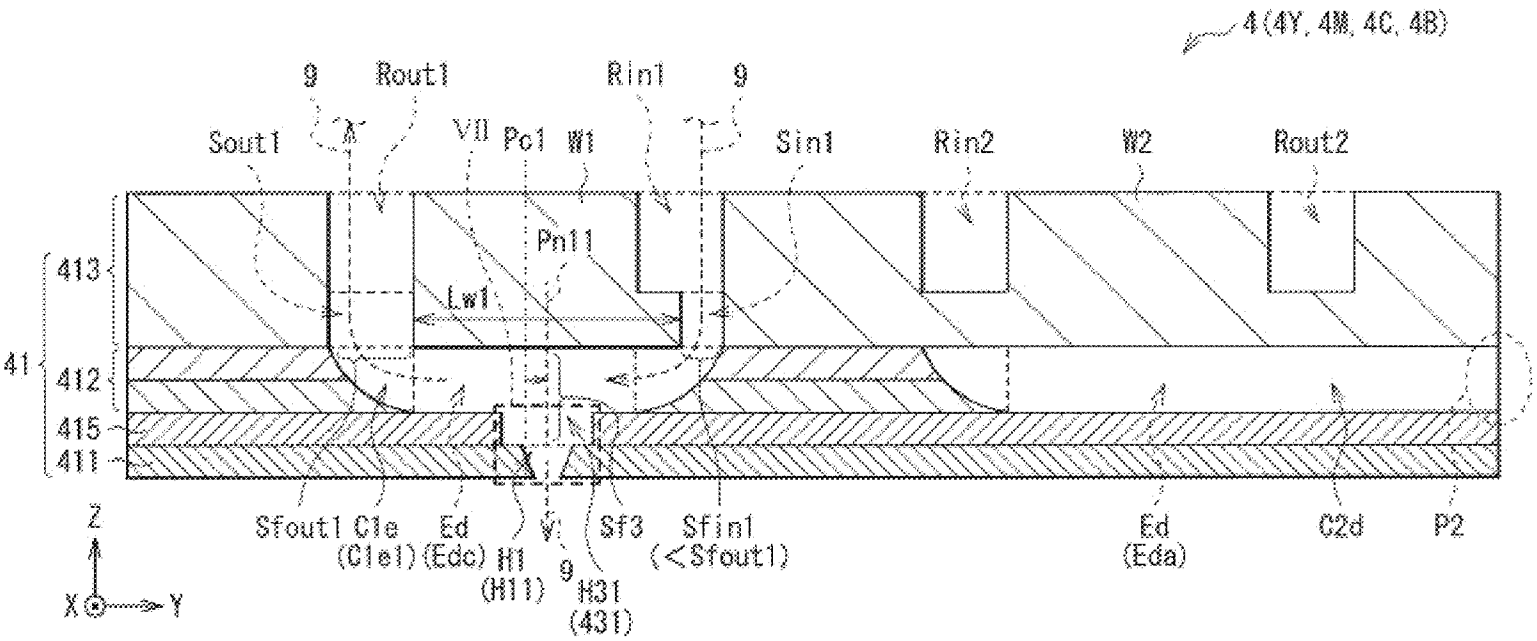
FIG. 3 is a schematic diagram showing a cross-sectional configuration example along the line III-III shown in FIG. 2.
Figure 4:
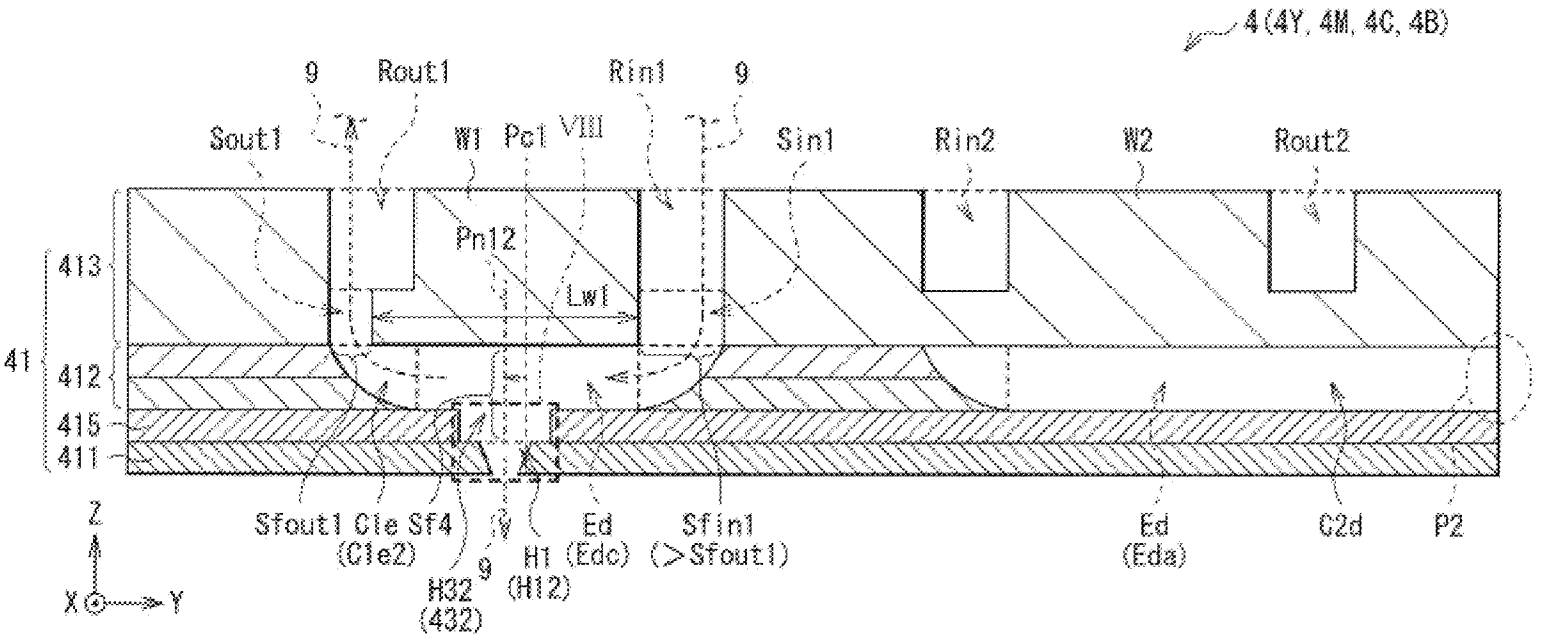
FIG. 4 is a schematic diagram showing a cross-sectional configuration example along the line IV-IV shown in FIG. 2.
Figure 5:
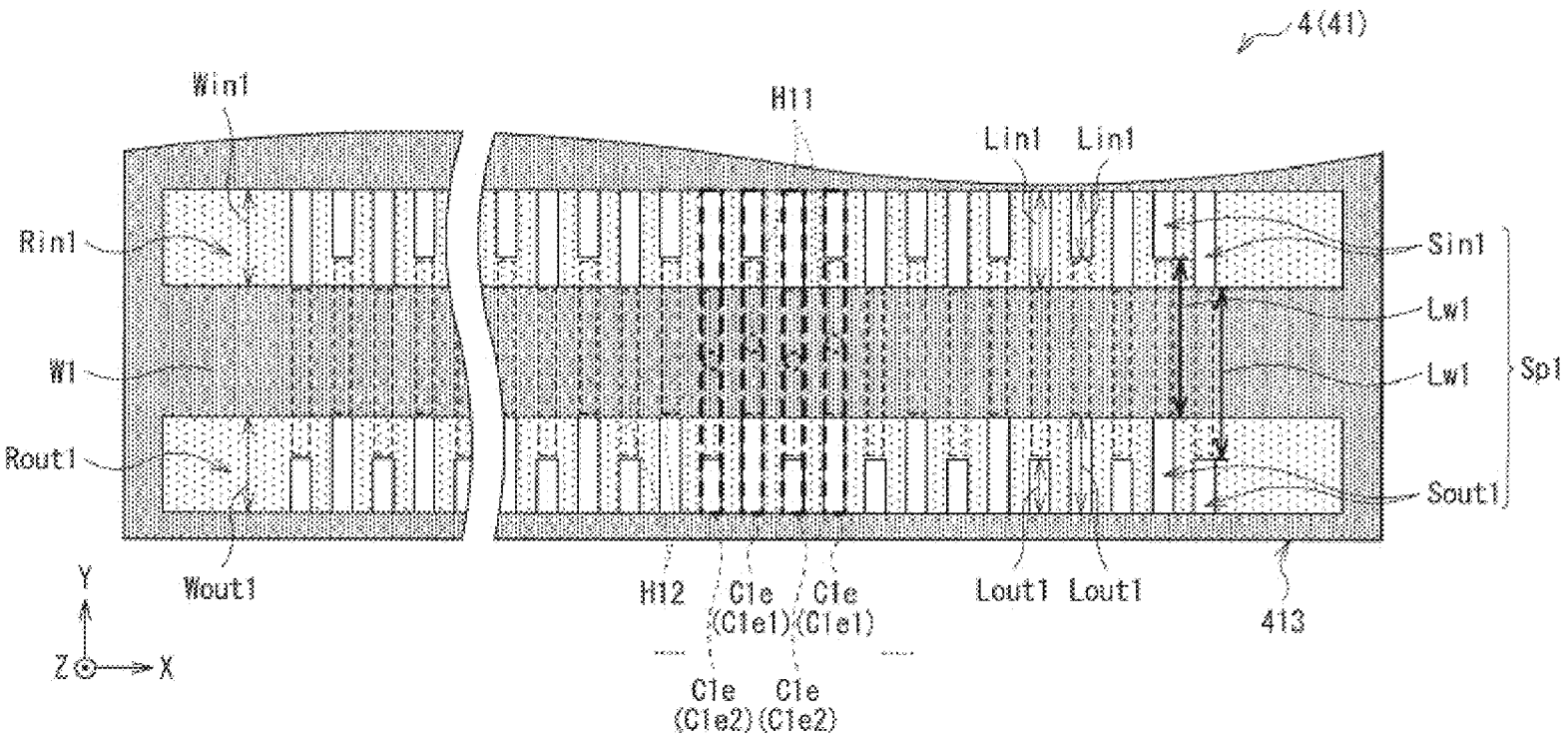
FIG. 5 is a schematic diagram showing a planar configuration example of the liquid jet head on the upper surface side of a cover plate shown in FIG. 3 and FIG. 4.
Figure 6:
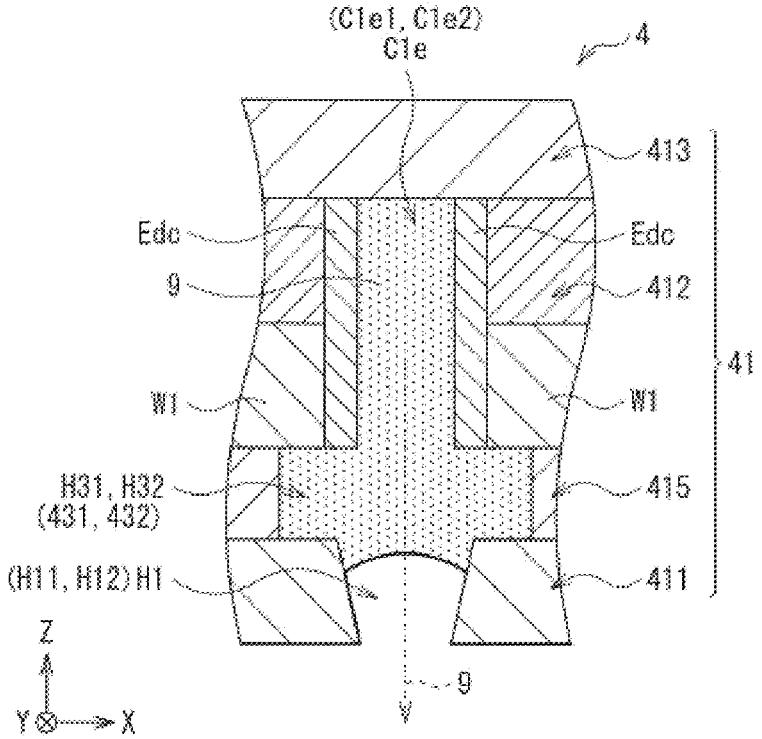
FIG. 6 is a schematic diagram showing another cross-sectional configuration example in a head chip shown in FIG. 3 and FIG. 4.

FIG. 2 is a diagram schematically showing a bottom view (an X-Y bottom view) of a configuration example of the inkjet head 4 in the state in which a nozzle plate 411 (described later) is detached. FIG. 3 is a diagram schematically showing a cross-sectional configuration example (a Y-Z cross-sectional configuration example) of the inkjet head 4 along the line III-III shown in FIG. 2. Similarly, FIG. 4 is a diagram schematically showing a cross-sectional configuration example (a Y-Z cross-sectional configuration example) of the inkjet head 4 along the line IV-IV shown in FIG. 2. Further, FIG. 5 is a diagram schematically showing a planar configuration example (an X-Y planar configuration example) of the inkjet head 4 on the upper surface side of a cover plate 413 (described later) shown in FIG. 3 and FIG. 4. FIG. 6 is a diagram schematically showing another cross-sectional configuration example (a Z-X cross-sectional configuration example) in the head chip 41 shown in FIG. 3 and FIG. 4.

It should be noted that in FIG. 3 through FIG. 6, out of ejection channels C1*e*, C2*e* described later and nozzle holes H1, H2 described later, the ejection channel C1*e* and the nozzle hole H1 disposed so as to correspond to a nozzle array An1 described later are illustrated as a representative for the sake of convenience. In other words, the ejection channel C2*e* and the nozzle hole H2 disposed so as to correspond to a nozzle array An2 described later are provided with substantially the same configurations, and are therefore omitted from the illustration.

The inkjet heads 4 according to the present embodiment are each an inkjet head of a so-called side-shoot type for ejecting the ink 9 from a central part in an extending direction (the Y-axis direction) of a plurality of channels (a plurality of channels C1 and a plurality of channels C2) in a head chip 41 described later. Further, the inkjet heads 4 are each an inkjet head of a circulation type which uses the circulation channel 50 described above to thereby use the ink 9 while circulating the ink 9 between the inkjet head 4 and the ink tank 3.

As shown in FIG. 3 and FIG. 4, the inkjet heads 4 are each provided with the head chip 41. Further, the inkjet heads 4 are each provided with a circuit board and flexible printed circuit board (FPC) as a control mechanism (a mechanism for controlling the operation of the head chip 41) not shown.

The circuit board is a board for mounting a drive circuit (an electric circuit) for driving the head chip 41. The flexible printed circuit board is a board for electrically connecting the drive circuit on the circuit board and drive electrodes Ed described later in the head chip 41 to each other. It should be noted that it is arranged that such flexible printed circuit board is provided with a plurality of extraction electrodes as printed wiring.

As shown in FIG. 3, FIG. 4, and FIG. 6, the head chip 41 is a member for jetting the ink 9 along the Z-axis direction, and is configured using a variety of types of plates. Specifically, as shown in FIG. 3, FIG. 4, and FIG. 6, the head chip 41 is mainly provided with the nozzle plate (a jet hole plate) 411, the actuator plate 412, the cover plate 413, and an alignment plate 415. The nozzle plate 411, the actuator plate 412, the cover plate 413, and the alignment plate 415 are bonded to each other using, for example, an adhesive, and are stacked on one another in this order along the Z-axis direction. It should be noted that the description will hereinafter be presented with the cover plate 413 side along the Z-axis direction referred to as an upper side, and the nozzle plate 411 side referred to as a lower side.

(Nozzle Plate 411)

The nozzle plate 411 is formed of a film member made of polyimide or the like having a thickness of, for example, about 50 μm, and is bonded to a lower surface of the actuator plate 412 as shown in FIG. 3, FIG. 4, and FIG. 6. It should be noted that the constituent material of the nozzle plate 411 is not limited to the resin material such as polyimide, but can also be, for example, a metal material.

Further, as shown in FIG. 2, the nozzle plate 411 is provided with two nozzle arrays (the nozzle arrays An1, An2) each extending along the X-axis direction. These nozzle arrays An1, An2 are arranged at a predetermined distance along the Y-axis direction. As described above, the inkjet head 4 (the head chip 41) in the present embodiment is formed as a two-row type inkjet head (head chip).

Although described later in detail, the nozzle array An1 has a plurality of nozzle holes H1 formed side by side along the X-axis direction at predetermined intervals. These nozzle holes H1 each penetrate the nozzle plate 411 along the thickness direction of the nozzle plate 411 (the Z-axis direction), and are individually communicated with the respective ejection channels C1*e* in the actuator plate 412 described later as shown in, for example, FIG. 3, FIG. 4, and FIG. 6. Further, the formation pitch along the X-axis direction in the nozzle holes H1 is arranged to be the same (the same pitch) as the formation pitch along the X-axis direction in the ejection channels C1*e*. Although described later in detail, it is arranged that the ink 9 supplied from the inside of the ejection channel C1*e* is ejected (jetted) from each of the nozzle holes H1 in such a nozzle array An1.

Although described later in detail, the nozzle array An2 similarly has a plurality of nozzle holes H2 formed side by side along the X-axis direction at predetermined intervals. These nozzle holes H2 each penetrate the nozzle plate 411 along the thickness direction of the nozzle plate 411, and are individually communicated with the respective ejection channels C2*e* in the actuator plate 412 described later. Further, the formation pitch along the X-axis direction in the nozzle holes H2 is arranged to be the same as the formation pitch along the X-axis direction in the ejection channels C2*e*. Although described later in detail, it is arranged that the ink 9 supplied from the inside of the ejection channel C2*e* is also ejected from each of the nozzle holes H2 in such a nozzle array An2.

Further, as shown in FIG. 2, the nozzle holes H1 in the nozzle array An1 and the nozzle holes H2 in the nozzle array An2 are arranged in a staggered manner along the X-axis direction. Therefore, in each of the inkjet heads 4 according to the present embodiment, the nozzle holes H1 in the nozzle array An1 and the nozzle holes H2 in the nozzle array An2 are arranged in a zigzag manner (in a zigzag arrangement). It should be noted that such nozzle holes H1, H2 each have a tapered through hole gradually decreasing in diameter in a downward direction (see FIG. 3, FIG. 4, and FIG. 6).

Here, as shown in FIG. 2, in the nozzle plate 411 in the present embodiment, out of the plurality of nozzle holes H1 in the nozzle array An1, the nozzle holes H1 adjacent to each other along the X-axis direction are arranged so as to be shifted from each other along the extending direction (the Y-axis direction) of the ejection channels C1*e*. In other words, the whole of the plurality of nozzle holes H1 in the nozzle array An1 is arranged in a zigzag manner along the X-axis direction. Specifically, as shown in FIG. 2, it is arranged that the plurality of nozzle holes H1 in the nozzle array An1 includes a plurality of nozzle holes H11 belonging to a nozzle array An11 extending along the X-axis direction and a plurality of nozzle holes H12 belonging to a nozzle array An12 extending along the X-axis direction. Further, each of the nozzle holes H11 is arranged so as to be shifted toward the positive side (on a first supply slit Sin1 side described later) in the Y-axis direction with reference to a central position along the extending direction (the Y-axis direction) of the ejection channels C1*e*. In contrast, each of the nozzle holes H12 is arranged so as to be shifted toward the negative side (on a first discharge slit Sout1 side described later) in the Y-axis direction with reference to the central position along the extending direction of the ejection channels C1*e*.

Similarly, as shown in FIG. 2, in the nozzle plate 411, out of the plurality of nozzle holes H2 in the nozzle array An2, the nozzle holes H2 adjacent to each other along the X-axis direction are arranged so as to be shifted from each other along the extending direction (the Y-axis direction) of the ejection channels C2*e*. In other words, the whole of the plurality of nozzle holes H2 in the nozzle array An2 is arranged in a zigzag manner along the X-axis direction. Specifically, as shown in FIG. 2, it is arranged that the plurality of nozzle holes H2 in the nozzle array An2 includes a plurality of nozzle holes H21 belonging to a nozzle array An21 extending along the X-axis direction and a plurality of nozzle holes H22 belonging to a nozzle array An22 extending along the X-axis direction. Further, each of the nozzle holes H21 is arranged so as to be shifted toward the negative side (on a second supply slit side described later) in the Y-axis direction with reference to a central position along the extending direction (the Y-axis direction) of the ejection channels C2*e*. In contrast, each of the nozzle holes H22 is arranged so as to be shifted toward the positive side (on a second discharge slit side described later) in the Y-axis direction with reference to the central position along the extending direction of the ejection channels C2*e*.

Here, the nozzle holes H11, H21 described above each correspond to a specific example of a "first nozzle hole" in the present disclosure. Further, the nozzle holes H12, H22 each correspond to a specific example of a "second nozzle hole" in the present disclosure. It should be noted that the details of the arrangement configuration of such nozzle holes H1 (H11, H12), H2 (H21, H22) will be described later.

(Actuator Plate 412)

The actuator plate 412 is a plate formed of a piezoelectric material such as PZT (lead zirconate titanate). As shown in FIG. 3, FIG. 4, and FIG. 6, the actuator plate 412 is constituted by stacking two piezoelectric substrates different in polarization direction from each other on one another along the thickness direction (the Z-axis direction) (a so-called chevron type). It should be noted that the configuration of the actuator plate 412 is not limited to the chevron type. Specifically, it is also possible to form the actuator plate 412 with, for example, a single (unique) piezoelectric substrate having the polarization direction set to one direction along the thickness direction (the Z-axis direction) (a so-called cantilever type).

Further, as shown in FIG. 2, the actuator plate 412 is provided with two channel rows (channel rows 421, 422) each extending along the X-axis direction. These channel rows 421, 422 are arranged at a predetermined distance along the Y-axis direction.

In such an actuator plate 412, as shown in FIG. 2, an ejection area (jetting area) of the ink 9 is disposed in a central part (the formation areas of the channel rows 421, 422) along the X-axis direction. On the other hand, in the actuator plate 412, a non-ejection area (non-jetting area) of the ink 9 is disposed in each of the both end parts (non-formation areas of the channel rows 421, 422) along the X-axis direction. The non-ejection areas are each located on the outer side along the X-axis direction with respect to the ejection area described above. It should be noted that the both end parts along the Y-axis direction in the actuator plate 412 each constitute a tail part 420 as shown in FIG. 2.

As shown in FIG. 2, the channel row 421 described above has the plurality of channels C1. As shown in FIG. 2, these channels C1 each extend along the Y-axis direction in the actuator plate 412. Further, as shown in FIG. 2, these channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view of the Z-X cross-sectional surface.

As shown in FIG. 2, the channel row 422 similarly has the plurality of channels C2 each extending along the Y-axis direction. As shown in FIG. 2, these channels C2 are arranged side by side so as to be parallel to each other at predetermined intervals along the X-axis direction. Each of the channels C2 is also partitioned with the drive walls Wd described above, and forms a groove section having a recessed shape in the cross-sectional view of the Z-X cross-sectional surface.

Here, as shown in FIG. 2 through FIG. 6, in the channels C1, there exist the ejection channels C1*e* (the ejection grooves) for ejecting the ink 9, and the dummy channels C1*d* (the non-ejection grooves) not ejecting the ink 9. Each of the ejection channels C1*e* is communicated with the nozzle hole H1 in the nozzle plate 411 on the one hand (see FIG. 3, FIG.

4, and FIG. 6), but each of the dummy channels C1*d* is not communicated with the nozzle hole H1, and is covered with the upper surface of the nozzle plate 411 from below on the other hand.

The plurality of ejection channels C1*e* is disposed side by side so that the ejection channels C1*e* at least partially overlap each other along a predetermined direction (the X-axis direction), and in particular in the example shown in FIG. 2, the plurality of ejection channels C1*e* is disposed so as to entirely overlap each other along the X-axis direction. Thus, as shown in FIG. 2, it is arranged that the whole of the plurality of ejection channels C1*e* is arranged in a row along the X-axis direction. Similarly, the plurality of dummy channels C1*d* is arranged side by side along the X-axis direction, and in the example shown in FIG. 2, the whole of the plurality of dummy channels C1*d* is arranged in a row along the X-axis direction. Further, in the channel row 421, the ejection channels C1*e* and the dummy channels C1*d* described above are alternately arranged along the X-axis direction (see FIG. 2).

Further, as shown in FIG. 2 through FIG. 4, in the channels C2, there exist the ejection channels C2*e* (the ejection grooves) for ejecting the ink 9, and the dummy channels C2*d* (the non-ejection grooves) not ejecting the ink 9. Each of the ejection channels C2*e* is communicated with the nozzle hole H2 in the nozzle plate 411 on the one hand, but each of the dummy channels C2*d* is not communicated with the nozzle hole H2, and is covered with the upper surface of the nozzle plate 411 from below on the other hand (see FIG. 3 and FIG. 4).

The plurality of ejection channels C2*e* is disposed side by side so that the ejection channels C2*e* at least partially overlap each other along a predetermined direction (the X-axis direction), and in particular in the example shown in FIG. 2, the plurality of ejection channels C2*e* is disposed so as to entirely overlap each other along the X-axis direction. Thus, as shown in FIG. 2, it is arranged that the whole of the plurality of ejection channels C2*e* is arranged in a row along the X-axis direction. Similarly, the plurality of dummy channels C2*d* is arranged side by side along the X-axis direction, and in the example shown in FIG. 2, the whole of the plurality of dummy channels C2*d* is arranged in a row along the X-axis direction. Further, in the channel row 422, the ejection channels C2*e* and the dummy channels C2*d* described above are alternately arranged along the X-axis direction (see FIG. 2).

It should be noted that such ejection channels C1*e*, C2*e* each correspond to a specific example of the "ejection groove" in the present disclosure. Further, the X-axis direction corresponds to a specific example of a "predetermined direction" in the present disclosure, and the Y-axis direction corresponds to a specific example of an "extending direction of the ejection groove" in the present disclosure.

Here, as shown in FIG. 2 through FIG. 4, the ejection channel C1*e* in the channel row 421 and the dummy channel C2*d* in the channel row 422 are arranged in alignment with each other along the extending direction (the Y-axis direction) of the ejection channel C1*e* and the dummy channel C2*d*. Further, as shown in FIG. 2, the dummy channel C1*d* in the channel row 421 and the ejection channel C2*e* in the channel row 422 are arranged in alignment with each other along the extending direction (the Y-axis direction) of the dummy channel C1*d* and the ejection channel C2*e*.

Further, as shown in, for example, FIG. 4, the ejection channels C1*e* each have arc-like side surfaces with which the cross-sectional area of each of the ejection channels C1*e* gradually decreases in a direction from the cover plate 413 side (upper side) toward the nozzle plate 411 side (lower side). Similarly, the ejection channels C2*e* each have arc-like side surfaces with which the cross-sectional area of each of the ejection channels C2*e* gradually decreases in the direction from the cover plate 413 side toward the nozzle plate 411 side. It should be noted that it is arranged that the arc-like side surfaces of such ejection channels C1*e*, C2*e* are each formed by, for example, cutting work using a dicer.

It should be noted that the detailed configuration in the vicinity of the ejection channel C1*e* (and the vicinity of the ejection channel C2*e*) shown in FIG. 3 and FIG. 4 will be described later.

Further, as shown in FIG. 3, FIG. 4, and FIG. 6, drive electrodes Ed extending along the Y-axis direction are respectively disposed on inner side surfaces opposed to each other along the X-axis direction in each of the drive walls Wd described above. As the drive electrodes Ed, there exist common electrodes Edc disposed on inner side surfaces facing the ejection channels C1*e*, C2*e*, and individual electrodes (active electrodes) Eda disposed on the inner side surfaces facing the dummy channels C1*d*, C2*d*. It should be noted that the drive electrodes Ed (the common electrodes Edc and the active electrodes Eda) described above are each formed in the entire area in the depth direction (the Z-axis direction) on the inner side surface of the drive wall Wd (see FIG. 3 and FIG. 4).

The pair of common electrodes Edc opposed to each other in the same ejection channel C1*e* (or the same ejection channel C2*e*) are electrically connected to each other in a common terminal (a common interconnection) not shown. Further, the pair of individual electrodes Eda opposed to each other in the same dummy channel C1*d* (or the same dummy channel C2*d*) are electrically separated from each other. In contrast, the pair of individual electrodes Eda opposed to each other via the ejection channel C1*e* (or the ejection channel C2*e*) are electrically connected to each other in an individual terminal (an individual interconnection) not shown.

Here, in the tail part 420 (in the vicinity of an end part along the Y-axis direction in the actuator plate 412) described above, there is mounted the flexible printed circuit board described above for electrically connecting the drive electrodes Ed and the circuit board described above to each other. Interconnection patterns (not shown) provided to the flexible printed circuit board are electrically connected to the common interconnections and the individual interconnections described above. Thus, it is arranged that a drive voltage is applied to each of the drive electrodes Ed from the drive circuit on the circuit board described above via the flexible printed circuit board.

Further, in the tail parts 420 in the actuator plate 412, an end part along the extending direction (the Y-axis direction) of each of the dummy channels C1*d*, C2*d* has the following configuration.

That is, first, in each of the dummy channels C1*d*, C2*d*, one side along the extending direction thereof has an arc-like side surface with which the cross-sectional area of each of the dummy channels C1*d*, C2*d* gradually decreases in a direction toward the nozzle plate 411 (see FIG. 3 and FIG. 4). It should be noted that it is arranged that the arc-like side surfaces in such dummy channels C1*d*, C2*d* are each formed by, for example, the cutting work with the dicer similarly to the arc-like side surfaces in the ejection channels C1*e*, C2*e* described above. In contrast, in each of the dummy channels C1*d*, C2*d*, the other side (on the tail part 420 side) along the extending direction thereof opens up to an end part along the Y-axis direction in the actuator plate 412 (see the symbol P2 indicated by the dotted lines in FIG. 3 and FIG. 4). Further, as shown in, for example, FIG. 3 and FIG. 4, it is arranged that each of the individual electrodes Eda disposed so as to be opposed to each other on the both side surfaces along the X-axis direction in each of the dummy channels C1*d*, C2*d* also extends up to the end part along the Y-axis direction in the actuator plate 412.

(Cover Plate 413)

As shown in FIG. 3 through FIG. 6, the cover plate 413 is disposed so as to close the channels C1, C2 (the channel rows 421, 422) in the actuator plate 412. Specifically, the cover plate 413 is bonded to the upper surface of the actuator plate 412, and has a plate-like structure.

As shown in FIG. 3 through FIG. 5, the cover plate 413 is provided with a pair of entrance side common flow channels Rin1, Rin2, a pair of exit side common flow channels Rout1, Rout2, and wall parts W1, W2.

The wall part W1 is disposed so as to cover above the ejection channels C1*e* and the dummy channels C1*d*, and the wall part W2 is disposed so as to cover above the ejection channels C2*e* and the dummy channels C2*d* (see FIG. 3 and FIG. 4).

The entrance side common flow channels Rin1, Rin2 and the exit side common flow channels Rout1, Rout2 each extend along the X-axis direction, and are arranged side by side so as to be parallel to each other at predetermined distance along the X-axis direction as shown in, for example, FIG. 5. Among the above, the entrance side common flow channel Rin1 and the exit side common flow channel Rout1 are each formed in an area corresponding to the channel row 421 (the plurality of channels C1) in the actuator plate 412 (see FIG. 3 through FIG. 5). In contrast, the entrance side common flow channel Rin2 and the exit side common flow channel Rout2 are each formed in an area corresponding to the channel row 422 (the plurality of channels C2) in the actuator plate 412 (see FIG. 3 and FIG. 4).

The entrance side common flow channel Rin1 is formed in the vicinity of an inner end part along the Y-axis direction in each of the channels C1, and forms a groove section having a recessed shape (see FIG. 3 through FIG. 5). In areas corresponding respectively to the ejection channels C1*e* in the entrance side common flow channel Rin1, there are respectively formed first supply slits Sin1 penetrating the cover plate 413 along the thickness direction (the Z-axis direction) of the cover plate 413 (see FIG. 3 through FIG. 5). Similarly, the entrance side common flow channel Rin2 is formed in the vicinity of an inner end part along the Y-axis direction in each of the channels C2, and forms a groove section having a recessed shape (see FIG. 3 and FIG. 4). In areas corresponding respectively to the ejection channels C2*e* in the entrance side common flow channel Rin2, there are also formed second supply slits (not shown) penetrating the cover plate 413 along the thickness direction of the cover plate 413, respectively.

It should be noted that the first supply slits Sin1 and the second supply slits each correspond to a specific example of a "first through hole" in the present disclosure.

The exit side common flow channel Rout1 is formed in the vicinity of an outer end part along the Y-axis direction in each of the channels C1, and forms a groove section having a recessed shape (see FIG. 3 through FIG. 5). In areas corresponding respectively to the ejection channels C1*e* in the exit side common flow channel Rout1, there are respectively formed first discharge slits Sout1 penetrating the cover plate 413 along the thickness direction of the cover plate 413 (see FIG. 3 through FIG. 5). Similarly, the exit side common flow channel Rout2 is formed in the vicinity of an outer end part along the Y-axis direction in each of the channels C2, and forms a groove section having a recessed shape (see FIG. 3 and FIG. 4). In areas corresponding respectively to the ejection channels C2*e* in the exit side common flow channel Rout2, there are also formed second discharge slits (not shown) penetrating the cover plate 413 along the thickness direction of the cover plate 413, respectively.

It should be noted that the first discharge slits Sout1 and the second discharge slits each correspond to a specific example of a "second through hole" in the present disclosure.

Here, as shown in, for example, FIG. 5, the first supply slit Sin1 and the first discharge slit Sout1 in each of the ejection channels C1*e* described above form a first slit pair Sp1. In the first slit pair Sp1, the first supply slit Sin1 and the first discharge slit Sout1 are disposed side by side along the extending direction (the Y-axis direction) of the ejection channel C1*e*. Similarly, the second supply slit and the second discharge slit in each of the ejection channels C2*e* form a second slit pair (not shown). In the second slit pair, the second supply slit and the second discharge slit are disposed side by side along the extending direction (the Y-axis direction) of the ejection channel C2*e*.

In such a manner, it is arranged that the entrance side common flow channel Rin1 and the exit side common flow channel Rout1 are communicated with each of the ejection channels C1*e* via the first supply slit Sin1 and the first discharge slit Sout1, respectively (see FIG. 3 through FIG. 5). In other words, the entrance side common flow channel Rin1 is a common flow channel communicated with each of the first supply slits Sin1 of the respective first slit pairs Sp1 described above, and the exit side common flow channel Rout1 forms a common flow channel communicated with each of the first discharge slits Sout1 of the respective first slit pairs Sp1 (see FIG. 5). Further, the first supply slit Sin1 and the first discharge slit Sout1 each form a through hole through which the ink 9 flows to and from the ejection channel C1*e*. In particular, as indicated by the dotted arrows in FIG. 3 and FIG. 4, the first supply slit Sin1 is a through hole for making the ink 9 inflow into the ejection channel C1*e*, and the first discharge slit Sout1 is a through hole for making the ink 9 outflow from the inside of the ejection channel C1*e*. In contrast, neither the entrance side common flow channel Rin1 nor the exit side common flow channel Rout1 is communicated with the dummy channels C1*d*. Specifically, each of the dummy channels C1*d* is arranged to be closed by bottom parts in the entrance side common flow channel Rin1 and the exit side common flow channel Rout1.

Similarly, it is arranged that the entrance side common flow channel Rin2 and the exit side common flow channel Rout2 are communicated with each of the ejection channels C2*e* via the second supply slit and the second discharge slit, respectively. In other words, the entrance side common flow channel Rin2 is a common flow channel communicated with each of the second supply slits of the respective second slit pairs described above, and the exit side common flow channel Rout2 forms a common flow channel communicated with each of the second discharge slits of the respective second slit pairs. Further, the second supply slit and the second discharge slit each form a through hole through which the ink 9 flows to and from the ejection channel C2*e*. In particular, the second supply slit is a through hole for making the ink 9 inflow into the ejection channel C2*e*, and the second discharge slit forms a through hole for making the ink 9 outflow from the inside of the ejection channel C2*e*.

In contrast, neither the entrance side common flow channel Rin2 nor the exit side common flow channel Rout2 is communicated with the dummy channels C2*d* (see FIG. 3 and FIG. 4). Specifically, each of the dummy channels C2*d* is arranged to be closed by bottom parts in the entrance side common flow channel Rin2 and the exit side common flow channel Rout2 (see FIG. 3 and FIG. 4).

(Alignment Plate 415)

As shown in FIG. 3, FIG. 4, and FIG. 6, the alignment plate 415 is disposed between the actuator plate 412 and the nozzle plate 411. The alignment plate 415 has a plurality of opening parts H31, H32 for performing the alignment of the nozzle holes H1, H2 when manufacturing the head chip 41 for the respective nozzle holes H1 (H11, H12), H2 (H21, H22). Specifically, the opening part H31 is disposed for each of the nozzle holes H11, H21, and at the same time, the opening part H32 is disposed for each of the nozzle holes H12, H22 (see FIG. 3, FIG. 4, and FIG. 6).

These opening parts H31, H32 respectively communicate the nozzle holes H11, H12, H21, and H22 with the ejection channels C1*e*1, C1*e*2, and each form an opening part having a roughly rectangular shape on the X-Y plane. The length (the opening length) in the Y-axis direction in each of the opening parts H31, H32 is made longer than the length in the Y-axis direction in each of the nozzle holes H11, H12, H21, and H22 (see FIG. 3 and FIG. 4). Further, the length in the X-axis direction in each of the opening parts H31, H32 is made longer than the length in the X-axis direction in each of the nozzle holes H11, H12, H21, and H22, and the length in the X-axis direction in each of the ejection channels C1*e*, C2*e* (see FIG. 6). In other words, as shown in, for example, FIG. 6, it is arranged that a small amount of positional error (a positional error in the X-Y plane) in the nozzle holes H1, H2 is tolerated due to such opening parts H31, H32 to thereby prevent such a positional error. Since such an alignment plate 415 is provided, it becomes easy to achieve the alignment between the actuator plate 412 and the nozzle plate 411 when manufacturing the head chip 41.

It should be noted that such opening parts H31, H32 each correspond to a specific example of a "third through hole" in the present disclosure.

Here, in the head chip 41 according to the present embodiment, it is arranged that expansion flow channel parts 431, 432 described below are formed so as to include the opening parts H31, H32 in such an alignment plate 415, respectively.

The expansion flow channel part 431 is formed in the vicinity of the nozzle hole H11, H21, and forms a flow channel for expanding the cross-sectional area (the flow channel cross-sectional area Sf3) of the flow channel of the ink 9 in the vicinity of the nozzle hole H11, H21 although described later in detail (see, e.g., FIG. 3). Similarly, the expansion flow channel part 432 is formed in the vicinity of the nozzle hole H12, H22, and forms a flow channel for expanding the cross-sectional area (the flow channel cross-sectional area Sf4) of the flow channel of the ink 9 in the vicinity of the nozzle hole H12, H22 although described later in detail (see, e.g., FIG. 4).

It should be noted that such an expansion flow channel part 431 corresponds to a specific example of a "first expansion flow channel part" in the present disclosure. Similarly, the expansion flow channel part 432 corresponds to a specific example of a "second expansion flow channel part" in the present disclosure. Further, the flow channel cross-sectional area Sf3 described above corresponds to a specific example of a "third cross-sectional area" in the present disclosure. Similarly, the flow channel cross-sectional area Sf4 described above corresponds to a specific example of a "fourth cross-sectional area" in the present disclosure.

[C. Detailed Configuration Around Ejection Channels C1*e*, C2*e*]

Then, a detailed configuration of the nozzle holes H1, H2 and the cover plate 413 in the vicinity of the ejection channels C1*e*, C2*e* will be described with reference to FIG. 2 through FIG. 5.

First, in the head chip 41 according to the present embodiment, as described above, the plurality of nozzle holes H1 includes the two types of nozzle holes H11, H12, and at the same time, the plurality of nozzle holes H2 includes the two types of nozzle holes H21, H22 (see FIG. 2).

Here, a central position Pn11 of each of the nozzle holes H11 is disposed so as to be shifted toward the positive side (on the first supply slit Sin1 side) in the Y-axis direction with reference to a central position Pc1 (i.e., a central position along the Y-axis direction of the wall part W1) along the extending direction (the Y-axis direction) of the ejection channels C1*e* (see FIG. 3 and FIG. 5). Similarly, a central position of each of the nozzle holes H21 is disposed so as to be shifted toward the negative side (on the second supply slit side) in the Y-axis direction with reference to a central position (i.e., a central position along the Y-axis direction of the wall part W2) along the extending direction (the Y-axis direction) of the ejection channels C2*e* (see FIG. 2).

In contrast, the central position Pn12 of each of the nozzle holes H12 is disposed so as to be shifted toward the negative side (on the first discharge slit Sout1 side) in the Y-axis direction with reference to the central position Pc1 along the extending direction of the ejection channels C1*e* (see FIG. 4 and FIG. 5). Similarly, a central position of each of the nozzle holes H22 is disposed so as to be shifted toward the positive side (on the second discharge slit side) in the Y-axis direction with reference to a central position along the extending direction (the Y-axis direction) of the ejection channels C2*e* (see FIG. 2).

Therefore, in each of the ejection channels C1*e* (C1*e*1) communicated with the respective nozzle holes H11, the cross-sectional area (the cross-sectional area Sfin1 of the first entrance side flow channel) of the flow channel of the ink 9 in a part communicated with the first supply slit Sin1 is made smaller than the cross-sectional area (the cross-sectional area Sfout1 of the first exit side flow channel) of the flow channel of the ink 9 in a part communicated with the first discharge slit Sout1 (Sfin1<Sfout1; see FIG. 3). Similarly, in each of the ejection channels C2*e* communicated with the respective nozzle holes H21, the cross-sectional area (the cross-sectional area of the second entrance side flow channel) of the flow channel of the ink 9 in a part communicated with the second supply slit is made smaller than the cross-sectional area (the cross-sectional area of the second exit side flow channel) of the flow channel of the ink 9 in a part communicated with the second discharge slit (Sfin2<Sfout2).

In contrast, in each of the ejection channels C1*e* (C1*e*2) communicated with the respective nozzle holes H12, on the contrary, the cross-sectional area Sfout1 of the first exit side flow channel described above is made smaller than the cross-sectional area Sfin1 of the first entrance side flow channel described above (Sfout1<Sfin1; see FIG. 4). Similarly, in each of the ejection channels C2*e* communicated with the respective nozzle holes H22, on the contrary, the cross-sectional area Sfout2 of the second exit side flow channel described above is also made smaller than the cross-sectional area Sfin2 of the second entrance side flow channel described above (Sfout2<Sfin2).

It should be noted that the ejection channels C1e1 described above and the ejection channels C2e communicated with the nozzle holes H21 each correspond to a specific example of a "first ejection groove" in the present disclosure. Similarly, the ejection channels C1e2 described above and the ejection channels C2e communicated with the nozzle holes H22 each correspond to a specific example of a "second ejection groove" in the present disclosure. Further, the cross-sectional area Sfin1 of the first entrance side flow channel and the cross-sectional area of the second entrance side flow channel described above each correspond to a specific example of a "first cross-sectional area" in the present disclosure. Similarly, the cross-sectional area Sfout1 of the first exit side flow channel and the cross-sectional area of the second exit side flow channel described above each correspond to a specific example of a "second cross-sectional area" in the present disclosure. Further, the central position Pn11 of the nozzle hole H11 described above and the central position of the nozzle hole H21 each correspond to a specific example of a "first central position" in the present disclosure. Similarly, the central position Pn12 of the nozzle hole H12 described above and the central position of the nozzle hole H22 each correspond to a specific example of a "second central position" in the present disclosure.

Further, in the head chip 41, the length (a first pump length Lw1; see FIG. 3 and FIG. 4) in the extending direction (the Y-axis direction) of the ejection channel C1e corresponding to a distance between the first supply slit Sin1 and the first discharge slit Sout1 in the first slit pair Sp1 described above is made the same in all of the first slit pairs Sp1 (see FIG. 5). Similarly, the length (a second pump length) in the extending direction (the Y-axis direction) of the ejection channel C2e corresponding to a distance between the second supply slit and the second discharge slit in the second slit pair described above is also made the same in all of the second slit pairs.

Further, in the head chip 41, the magnitude relationship between the length (a first supply slit length Lin1) in the Y-axis direction in the first supply slit Sin1 and the length (a first discharge slit length Lout1) in the Y-axis direction in the first discharge slit Sout1 is alternately flipped between the first slit pairs Sp1 adjacent to each other along the X-axis direction (see FIG. 5). In other words, for example, when there is a magnitude relationship of (Lin1>Lout1) in a certain first slit pair Sp1, there is a magnitude relationship of (Lin1<Lout1) on the contrary in each of the first slit pairs Sp1 located on both sides of that first slit pair Sp1. Further, for example, when there is the magnitude relationship of (Lin1<Lout1) in a certain first slit pair Sp1, there is the magnitude relationship of (Lin1>Lout1) on the contrary in each of the first slit pairs Sp1 located on both sides of that first slit pair Sp1.

Similarly, a magnitude relationship between the length (a second supply slit length) in the Y-axis direction in the second supply slit and the length (a second discharge slit length) in the Y-axis direction in the second discharge slit is also alternately flipped in such a manner as described above between the second slit pairs adjacent to each other along the X-axis direction.

Further, in the head chip 41, the length (the first entrance side flow channel width Win1) in the Y-axis direction in the entrance side common flow channel Rin1 is made constant along the extending direction (the X-axis direction) of the entrance side common flow channel Rin1 (see FIG. 5). Further, the length (the first exit side flow channel width Wout1) in the Y-axis direction in the exit side common flow channel Rout1 is also made constant along the extending direction (the X-axis direction) of the exit side common flow channel Rout1 (see FIG. 5).

Similarly, the length (the second entrance side flow channel width) in the Y-axis direction in the entrance side common flow channel Rin2 is also made constant along the extending direction (the X-axis direction) of the entrance side common flow channel Rin2. Further, the length (the second exit side flow channel width) in the Y-axis direction in the exit side common flow channel Rout2 is also made constant along the extending direction (the X-axis direction) of the exit side common flow channel Rout2.

[D. Detailed Configuration of Expansion Flow Channel Parts 431, 432]

Figures 7A, 7B:
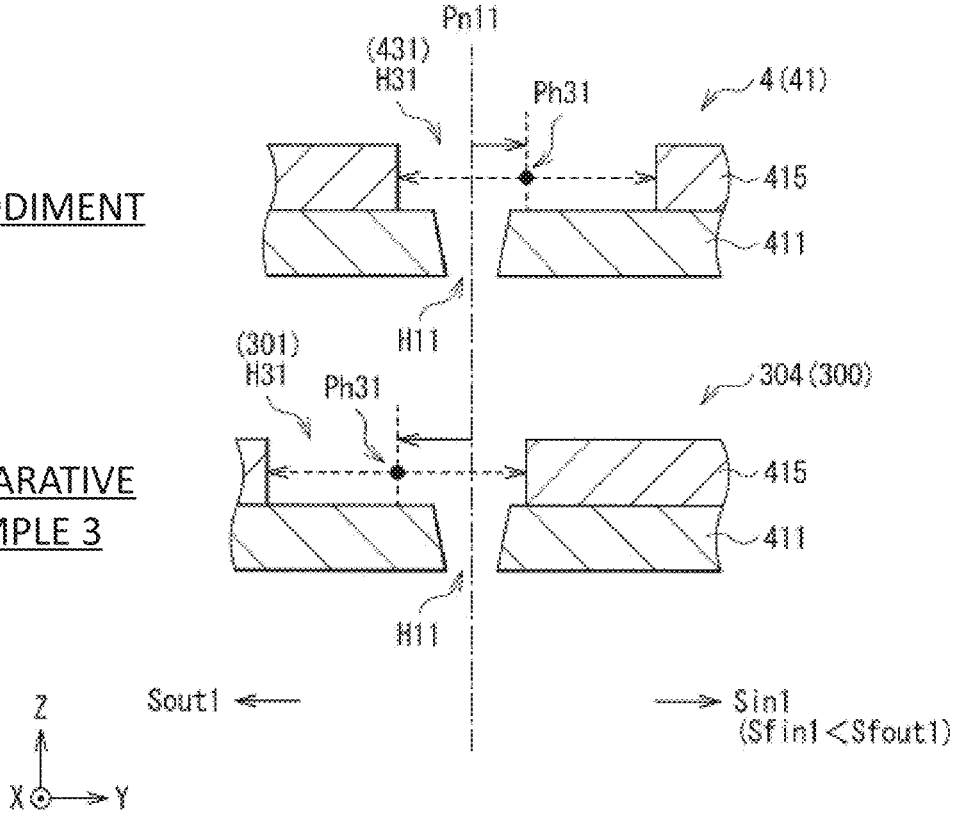
Figure 8A:
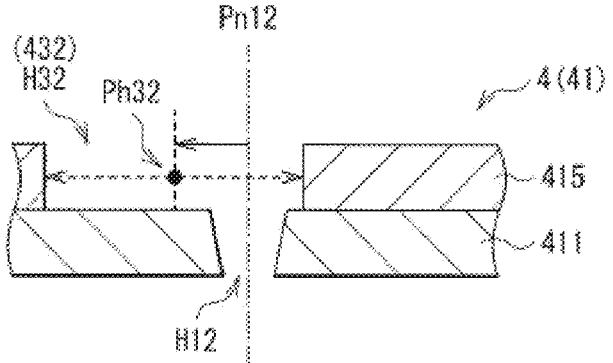
Figure 8B:
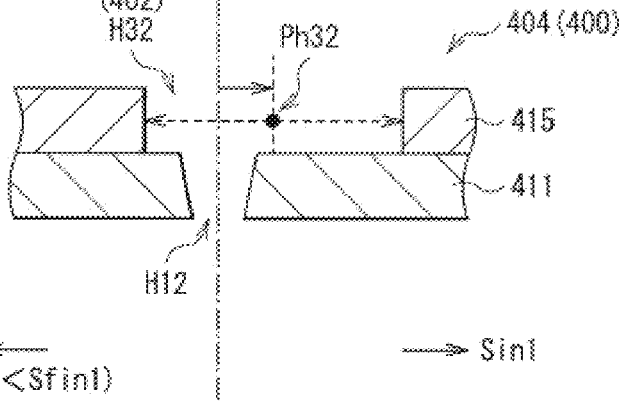
Figure 8B:
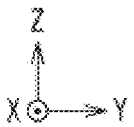

Then, the detailed configuration of the expansion flow channel parts 431, 432 described above will be described with reference to FIGS. 7A and 7B and FIGS. 8A and 8B in addition to FIG. 3 and FIG. 4. FIGS. 7A and 7B and FIGS. 8A and 8B are each a cross-sectional view (a Y-Z cross-sectional view) schematically showing an example of a positional relationship between the nozzle holes H1, H2 and the expansion flow channel part related to the present embodiment and so on. Specifically, FIG. 7A is a diagram showing a cross-sectional configuration in the vicinity of a part denoted by the symbol VII in FIG. 3 in an enlarged manner, and FIG. 7B is a diagram showing a cross-sectional configuration in an inkjet head 304 (a head chip 300) according to Comparative Example 3 described later in comparison with FIG. 7A. Further, FIG. 8A is a diagram showing a cross-sectional configuration in the vicinity of a part denoted by the symbol VIII in FIG. 4 in an enlarged manner, and FIG. 8B is a diagram showing a cross-sectional configuration in an inkjet head 404 (a head chip 400) according to Comparative Example 4 described later in comparison with FIG. 8A.

First, in the head chip 41 according to the present embodiment, both end parts along the Y-axis direction in these expansion flow channel parts 431, 432 (the opening parts H31, H32) are located on the inner side (in a so-called pump chamber) of both end parts along the Y-axis direction in the wall part W1 (or the wall part W2) (see FIG. 3 and FIG. 4).

Specifically, as shown in FIG. 3, defining the end part on the first supply slit Sin1 side in the wall part W1 as a reference position, the end part on the first supply slit Sin1 side in the expansion flow channel part 431 is disposed on the first discharge slit Sout1 side of the reference position. Further, defining the end part on the first discharge slit Sout1 side in the wall part W1 as a reference position, the end part on the first discharge slit Sout1 side in the expansion flow channel part 431 is also disposed on the first supply slit Sin1 side of the reference position. Similarly, defining the end part on the second supply slit side in the wall part W2 as a reference position, the end part on the second supply slit side in the expansion flow channel part 431 is disposed on the second discharge slit side described above of the reference position. Further, defining the end part on the second discharge slit side in the wall part W2 as a reference position, the end part on the second discharge slit side in the expansion flow channel part 431 is also disposed on the second supply slit side of the reference position.

In contrast, as shown in FIG. 4, defining the end part on the first discharge slit Sout1 side in the wall part W1 as a reference position, the end part on the first discharge slit Sout1 side in the expansion flow channel part 432 is disposed on the first supply slit Sin1 side of the reference position. Further, defining the end part on the first supply slit Sin1 side in the wall part W1 as a reference position, the end part on the first supply slit Sin1 side in the expansion flow channel part 432 is also disposed on the first discharge slit Sout1 side of the reference position. Similarly, defining the end part on the second discharge slit side in the wall part W2 as a reference position, the end part on the second discharge slit side in the expansion flow channel part 432 is disposed on the second supply slit side of the reference position. Further, defining the end part on the second supply slit side in the wall part W2 as a reference position, the end part on the second supply slit side in the expansion flow channel part 432 is also disposed on the second discharge slit side of the reference position.

Further, as shown in FIG. 7A, in the head chip 41 according to the present embodiment, the central position Ph31 along the Y-axis direction in the expansion flow channel part 431 is shifted toward the first supply slit Sin1 along the Y-axis direction from the central position Pn11 of the nozzle hole H11. Similarly, in the head chip 41, the central position Ph31 along the Y-axis direction in the expansion flow channel part 431 is shifted toward the second supply slit along the Y-axis direction from the central position of the nozzle hole H21.

It should be noted that in contrast, in the head chip 300 according to Comparative Example 3 shown in FIG. 7B, the central position Ph31 along the Y-axis direction in the expansion flow channel part 301 is shifted in the opposite direction toward the first discharge slit Sout1 along the Y-axis direction from the central position Pn11 of the nozzle hole H11. Similarly, in the head chip 300 according to Comparative Example 3, the central position Ph31 along the Y-axis direction in the expansion flow channel part 301 is shifted in the opposite direction toward the second discharge slit along the Y-axis direction from the central position of the nozzle hole H21.

In contrast, as shown in FIG. 8A, in the head chip 41 according to the present embodiment, the central position Ph32 along the Y-axis direction in the expansion flow channel part 432 is shifted toward the first discharge slit Sout1 along the Y-axis direction from the central position Pn12 of the nozzle hole H12. Similarly, in the head chip 41, the central position Ph32 along the Y-axis direction in the expansion flow channel part 432 is shifted toward the second discharge slit along the Y-axis direction from the central position of the nozzle hole H22.

It should be noted that in contrast, in the head chip 400 according to Comparative Example 4 shown in FIG. 8B, the central position Ph32 along the Y-axis direction in the expansion flow channel part 402 is shifted in the opposite direction toward the first supply slit Sin1 along the Y-axis direction from the central position Pn12 of the nozzle hole H12. Similarly, in the head chip 400 according to Comparative Example 4, the central position Ph32 along the Y-axis direction in the expansion flow channel part 402 is shifted in the opposite direction toward the second supply slit along the Y-axis direction from the central position of the nozzle hole H22.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation channel 50, respectively.

In such an initial state, when operating the printer 1, the grit rollers 21 in the carrying mechanisms 2*a*, 2*b* each rotate to thereby carry the recording paper P along the carrying direction d (the X-axis direction) between the grit rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Then, the detailed operation (a jet operation of the ink 9) in the inkjet head 4 will be described. Specifically, in this inkjet head 4 (side-shoot type), the jet operation of the ink 9 using the shear mode is performed in the following manner.

First, when the reciprocation of the carriage 62 (see FIG. 1) described above is started, the drive circuit on the circuit board described above applies the drive voltage to the drive electrodes Ed (the common electrodes Edc and the individual electrodes Eda) in the inkjet head 4 via the flexible printed circuit boards described above. Specifically, the drive circuit applies the drive voltage to the drive electrodes Ed disposed on the pair of drive walls Wd forming the ejection channel C1*e*, C2*e*. Thus, the pair of drive walls Wd each deform so as to protrude toward the dummy channel C1*d*, C2*d* adjacent to the ejection channel C1*e*, C2*e*.

Here, since the configuration of the actuator plate 412 is made to be the chevron type described above, by applying the drive voltage using the drive circuit described above, it results that the drive wall Wd makes a flexion deformation to have a V shape centering on an intermediate position in the depth direction in the drive wall Wd. Further, due to such a flexion deformation of the drive wall Wd, the ejection channel C1*e*, C2*e* deforms as if the ejection channel C1*e*, C2*e* bulges.

Incidentally, when the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force being exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the volume of the ejection channel C1*e*, C2*e* increases. Further, due to the increase in the volume of the ejection channel C1*e*, C2*e*, it results that the ink 9 retained in the entrance side common flow channel Rin1, Rin2 is induced into the ejection channel C1*e*, C2*e*.

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing (or the timing in the vicinity of the timing) at which the pressure wave has reached the nozzle hole H1, H2 of the nozzle plate 411. Thus, the drive walls Wd are restored from the state of the flexion deformation described above, and as a result, the volume of the ejection channel C1*e*, C2*e* having once increased is restored again.

In the process in which the volume of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 3, FIG. 4, and FIG. 6) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

(C. Circulation Operation of Ink 9)

Then, the circulation operation of the ink 9 via the circulation channel 50 will be described in detail with reference to FIG. 1, FIG. 3, and FIG. 4.

In the printer 1, the ink 9 is fed by the liquid feeding pump described above from the inside of the ink tank 3 to the inside of the flow channel 50*a*. Further, the ink 9 flowing through the flow channel 50*b* is fed by the liquid feeding pump described above to the inside of the ink tank 3.

On this occasion, in the inkjet head 4, the ink 9 flowing from the inside of the ink tank 3 via the flow channel 50*a* inflows into the entrance side common flow channels Rin1, Rin2. The ink 9 having been supplied to these entrance side common flow channels Rin1, Rin2 is supplied to the ejection channels C1*e*, C2*e* in the actuator plate 412 via the first supply slit Sin1 and the second supply slit, respectively (see FIG. 3 and FIG. 4).

Further, the ink 9 in the ejection channels C1*e*, C2*e* flows into the exit side common flow channels Rout1, Rout2 via the first discharge slit Sout1 and the second discharge slit, respectively (see FIG. 3 and FIG. 4). The ink 9 supplied to these exit side common flow channels Rout1, Rout2 is discharged to the flow channel 50*b* to thereby outflow from the inside of the inkjet head 4. Then, the ink 9 having been discharged to the flow channel 50*b* is returned to the inside of the ink tank 3 as a result. In such a manner, the circulation operation of the ink 9 via the circulation channel 50 is achieved.

Here, in the inkjet head of a type other than the circulation type, when using fast drying ink, there is a possibility that a local increase in viscosity or local solidification of the ink occurs due to drying of the ink in the vicinity of the nozzle hole, and as a result, a failure such as an ink ejection failure occurs. In contrast, in the inkjet heads 4 (the circulation type inkjet heads) according to the present embodiment, since the fresh ink 9 is always supplied to the vicinity of the nozzle holes H1, H2, the failure such as the ink ejection failure described above is avoided as a result.

(D. Functions/Advantages)

Then, functions and advantages in the inkjet head 4 according to the present embodiment will be described in detail in comparison with the comparative examples (Comparative Example 1 through Comparative Example 4).

(D-1. Comparative Example 1)

Figure 9:
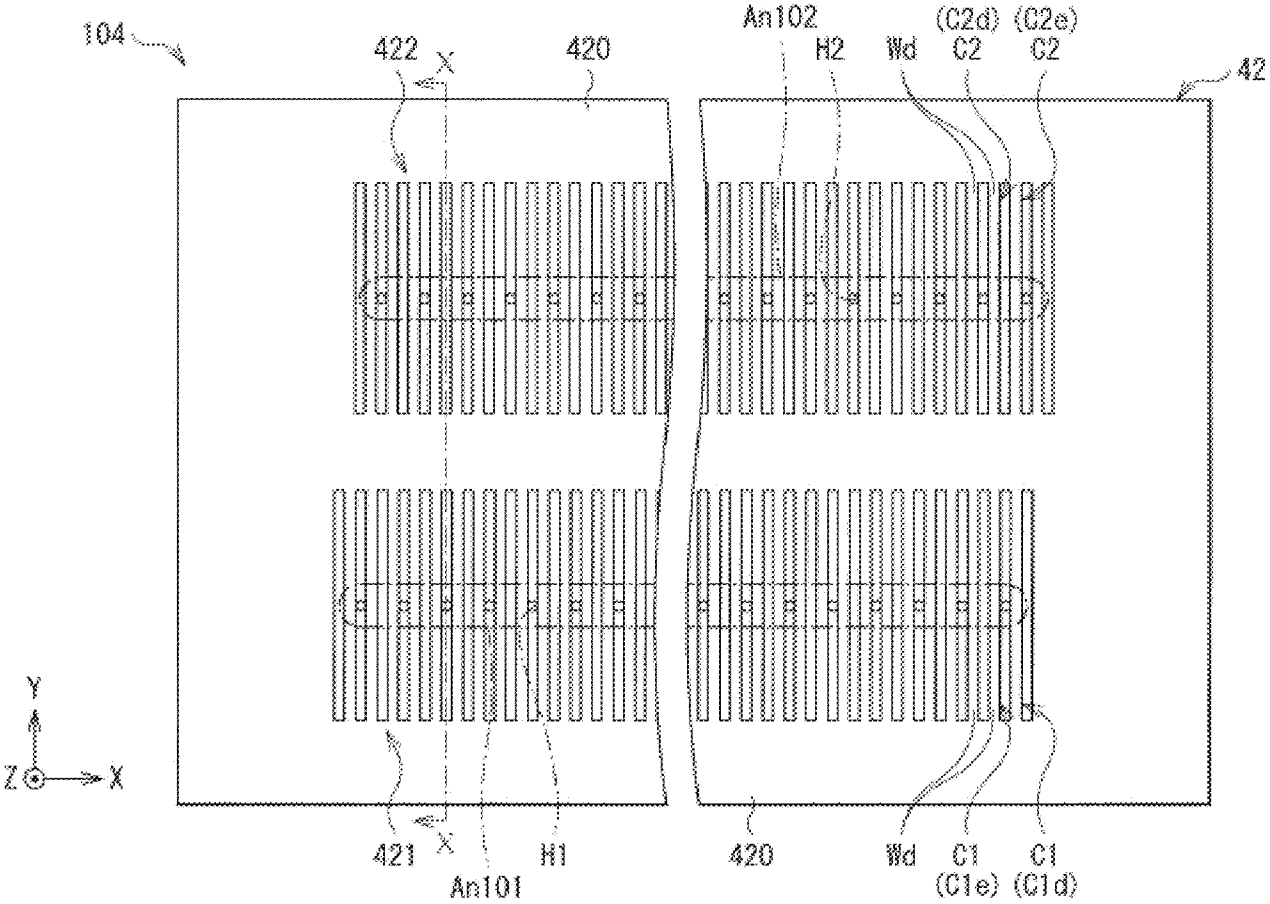
FIG. 9 is a schematic bottom view showing a configuration example of a liquid jet head according to Comparative Example 1 in the state in which a nozzle plate is detached.
Figure 10:
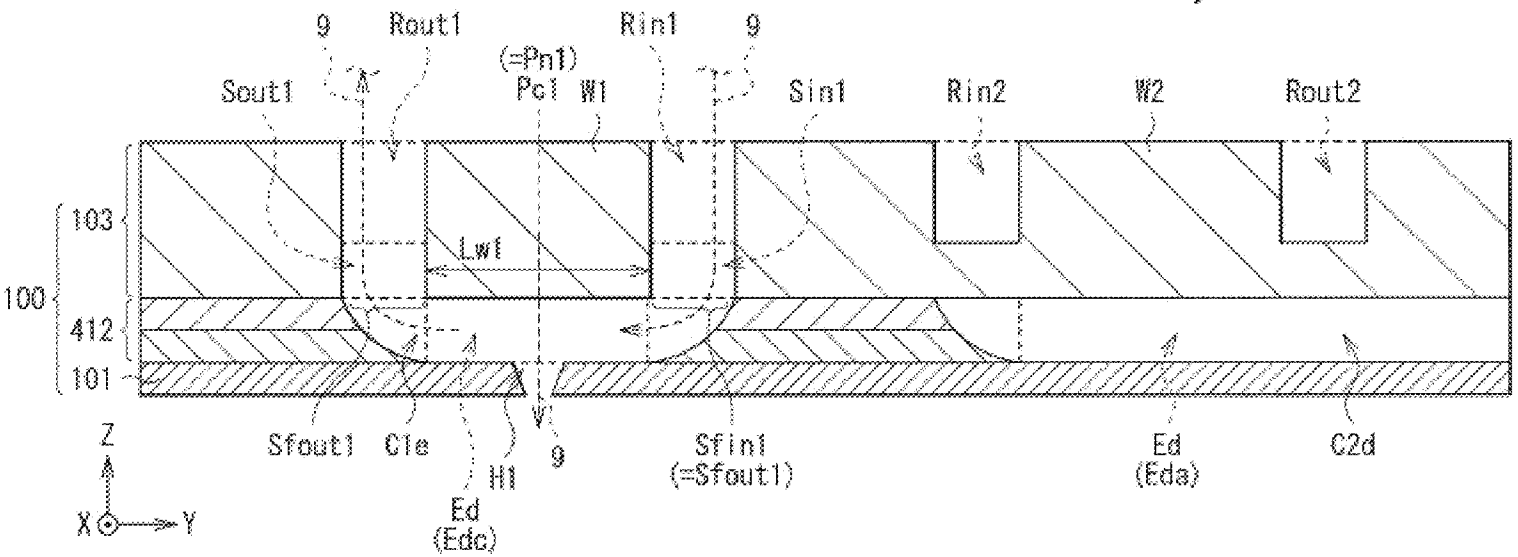
FIG. 10 is a schematic diagram showing a cross-sectional configuration example along the line X-X shown in FIG. 9.

FIG. 9 is a bottom view (an X-Y bottom view) schematically showing a configuration example of the inkjet head 104 according to Comparative Example 1 in the state in which a nozzle plate 101 (described later) according to Comparative Example 1 is detached. FIG. 10 is a diagram schematically showing a cross-sectional configuration example (a Y-Z cross-sectional configuration example) of the inkjet head 104 according to Comparative Example 1 along the line X-X shown in FIG. 9.

As shown in FIG. 9 and FIG. 10, the inkjet head 104 (the head chip 100) according to Comparative Example 1 differs in arrangement configuration of the nozzle holes H1, H2 from the inkjet head 4 (the head chip 41) according to the present embodiment.

Specifically, in the nozzle plate 101 according to Comparative Example 1, unlike the nozzle plate 411 in the present embodiment, nozzle holes H1, H2 in respective nozzle arrays An101, An102 are each arranged in a row along the extending direction (the X-axis direction) of the nozzle arrays An101, An102 (see FIG. 9). Specifically, unlike the case of the present embodiment described above, in Comparative Example 1, it is arranged that the central position Pn1 of each of the nozzle holes H1 coincides with the central position Pc1 (i.e., the central position along the Y-axis direction of the wall part W1) along the extending direction (the Y-axis direction) of the ejection channel C1*e* (see FIG. 10). Similarly, in Comparative Example 1, it is arranged that the central position of each of the nozzle holes H2 coincides with the central position (i.e., the central position along the Y-axis direction of the wall part W2) along the extending direction (the Y-axis direction) of the ejection channel C2*e*.

In such Comparative Example 1, as described above, since the nozzle holes H1, H2 are each arranged in a row along the X-axis direction, when the distance between the nozzle holes H1 adjacent to each other and the distance between the nozzle holes H2 adjacent to each other decrease due to, for example, an increase in resolution of the print pixels, there is a possibility described below, for example. That is, in such a case, since the distance between the droplets which are jetted around the same time and flying toward the recording target medium (e.g., the recording paper P) decreases, the droplets flying between the nozzle holes H1, H2 and the recording target medium are locally concentrated in some cases. Thus, the influence (generation of an air current) on each of the droplets thus flying increases, and as a result, there is a possibility that a wood-effect unevenness in concentration occurs on the recording target medium to degrade the print image quality.

(D-2. Comparative Example 2)

Figure 11:
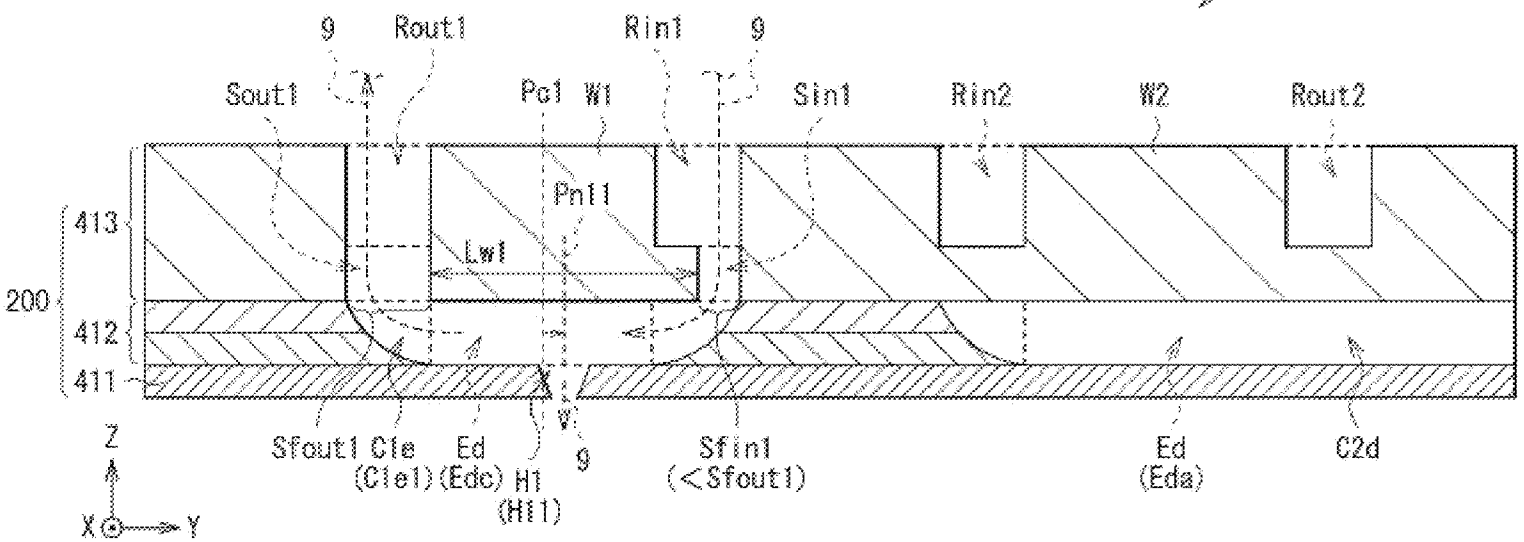
FIG. 11 is a schematic diagram showing a cross-sectional configuration example in the liquid jet head according to Comparative Example 2.
Figure 12:
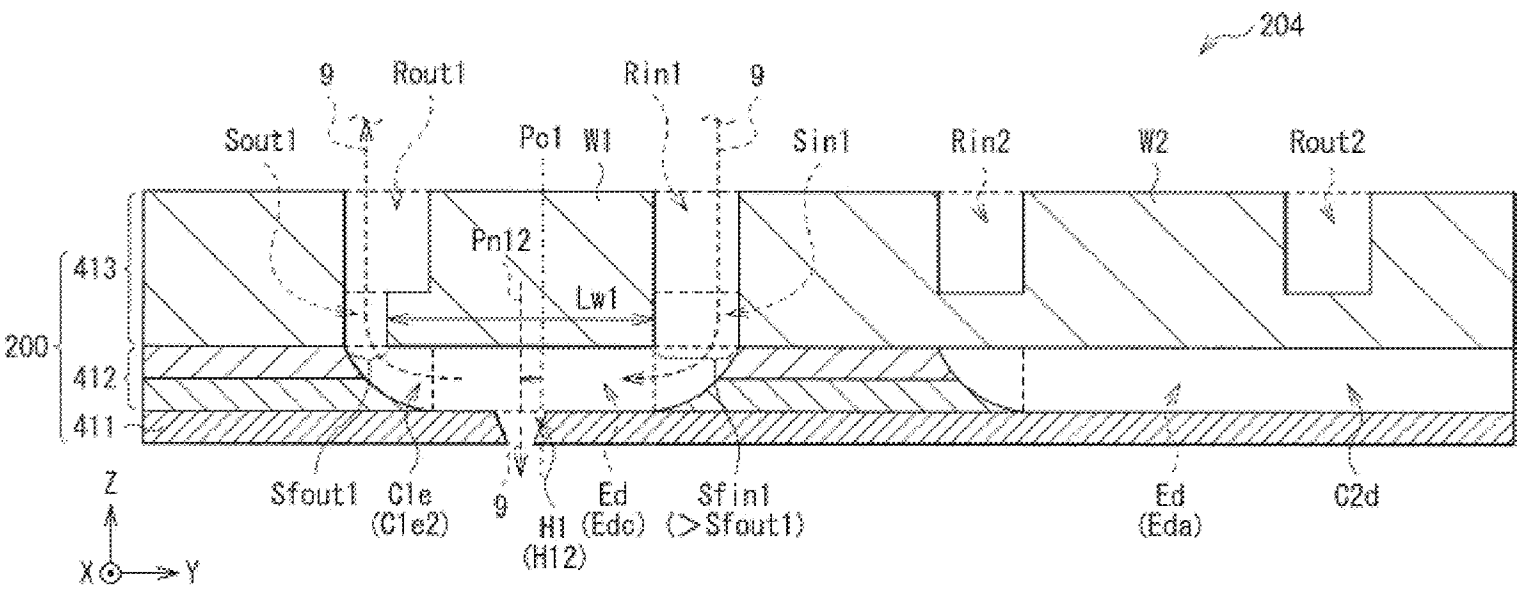
FIG. 12 is a schematic diagram showing another cross-sectional configuration example in the liquid jet head according to Comparative Example 2.

FIG. 11 and FIG. 12 are each a diagram schematically showing a cross-sectional configuration example (a Y-Z cross-sectional configuration example) of an inkjet head 204 (a head chip 200) according to Comparative Example 2. Specifically, FIG. 11 shows the cross-sectional configuration example corresponding to a part including the nozzle hole H11 (the ejection channel C1*e*1) in the inkjet head 204 according to Comparative Example 2, and corresponds to FIG. 3 in the present embodiment. Further, FIG. 12 shows the cross-sectional configuration example corresponding to a part including the nozzle hole H12 (the ejection channel C1*e*2) in the inkjet head 204 according to Comparative Example 2, and corresponds to FIG. 4 in the present embodiment.

The inkjet head 204 (the head chip 200) according to Comparative Example 2 corresponds to a configuration obtained by omitting the alignment plate 415 (the expansion flow channels 431, 432) described above in the inkjet head 4 (the head chip 41) according to the present embodiment (see FIG. 3 and FIG. 4).

Therefore, also in Comparative Example 2, the following results in substantially the same manner as in the present embodiment unlike Comparative Example 1. That is, the central position Pn11 of the nozzle hole H11 is disposed so as to be shifted toward the first supply slit Sin1 with reference to the central position Pc1 along the extending direction (the Y-axis direction) of the ejection channel C1*e*, and at the same time, the central position Pn12 of the nozzle hole H12 is disposed so as to be shifted toward the first discharge slit Sout1 with reference to the central position Pc1 described above. Similarly, the central position of the nozzle hole H21 is disposed so as to be shifted toward the second supply slit with reference to the central position along the extending direction (the Y-axis direction) of the ejection channel C2*e*, and at the same time, the central position of the nozzle hole H22 is disposed so as to be shifted toward the second discharge slit with reference to the central position along the extending direction of the ejection channel C2*e*.

Thus, in Comparative Example 2, the distance between the nozzle holes H1 adjacent to each other (and the distance between the nozzle holes H2 adjacent to each other) becomes longer compared to (Comparative Example 1 described above) when the nozzle holes H1, H2 are each arranged in a row along the X-axis direction. Therefore, since the distance between the droplets which are jetted around the same time and flying toward the recording target medium (e.g., the recording paper P) increases, it is possible to relax the local concentration of the droplets flying between the nozzle holes H1, H2 and the recording target medium. Thus, in Comparative Example 2, the influence (the generation of the air current) on each of the droplets thus flying can be suppressed, and as a result, it is possible to suppress the occurrence of the wood-effect unevenness in concentration on the recording target medium described above compared to Comparative Example 1.

However, in Comparative Example 2, similarly to the present embodiment described above, in the ejection channels C1*e*1 communicated with the respective nozzle holes H11 and in the ejection channels C1*e*2 communicated with the respective nozzle holes H12, the flow channel cross-sectional area of the ink 9 is made as follows (see FIG. 11 and FIG. 12).

That is, in the ejection channels C1*e*1, the cross-sectional area Sfin1 of the first entrance side flow channel is made smaller than the cross-sectional area Sfout1 of the first exit side flow channel, and at the same time, in the ejection channels C1*e*2, the cross-sectional area Sfout1 of the first exit side flow channel is made smaller than the cross-sectional area Sfin1 of the first entrance side flow channel. It should be noted that also in the ejection channels C2*e* communicated with the respective nozzle holes H21 and the ejection channels C2*e* communicated with the respective nozzle holes H22, the flow channel cross-sectional area of the ink 9 has substantially the same magnitude relationship.

In such a manner, in Comparative Example 2, the cross-sectional area (the cross-sectional area Sfin1 of the first entrance side flow channel) of the flow channel part on the entrance side (the first supply slit Sin1 side) of the ink 9 differs between the ejection channels C1*e*1 and the ejection channels C1*e*2 as a result (see FIG. 11 and FIG. 12). Therefore, in Comparative Example 2, the pressure loss from the entrance side to the nozzle holes H11, H12 of the ink 9 described above also differs between the ejection channels C1*e*1 and the ejection channels C1*e*2 as a result. As a result, in Comparative Example 2, the pressure in the steady state in the vicinity of the nozzle hole H11, H12 also differs between the ejection channels C1*e*1 and the ejection channels C1*e*2, and thus, the head value margin in the whole of the head chip 200 decreases. Therefore, there is a possibility that the ejection characteristics of the ink 9 in the inkjet head 204 degrade.

Specifically, for example, despite the pressure enough for forming the appropriate meniscus is achieved in one of the ejection channels C1*e*1 and the ejection channels C1*e*2, there is a possibility that the pressure in the vicinity of the nozzle hole H11 or the nozzle hole H12 becomes excessively high to break the meniscus, and thus the ink 9 is leaked in the other thereof. Further, on the contrary, there is a possibility that such pressure becomes excessively low to break the meniscus, and thus a bubble is mixed into the ejection channel C1*e*1 or the ejection channel C1*e*2, and as a result, the ejection failure of the ink 9 occurs.

It should be noted that the degradation in ejection characteristics of the ink 9 due to such a difference in pressure can occur in substantially the same manner between the ejection channels C2*e* communicated with the respective nozzle holes H21 and the ejection channels C2*e* communicated with the respective nozzle holes H22.

(D-3. Present Embodiment)

In contrast, in the inkjet head 4 (the head chip 41) according to the present embodiment, first, the following configuration is adopted unlike the Comparative Example 1 in substantially the same manner as in Comparative Example 2 described above. That is, the central position Pn11 of the nozzle hole H11 is disposed so as to be shifted toward the first supply slit Sin1 with reference to the central position Pc1 along the extending direction (the Y-axis direction) of the ejection channel C1*e*, and at the same time, the central position Pn12 of the nozzle hole H12 is disposed so as to be shifted toward the first discharge slit Sout1 with reference to the central position Pc1 described above. Similarly, the central position of the nozzle hole H21 is disposed so as to be shifted toward the second supply slit with reference to the central position along the extending direction (the Y-axis direction) of the ejection channel C2*e*, and at the same time, the central position of the nozzle hole H22 is disposed so as to be shifted toward the second discharge slit with reference to the central position along the extending direction of the ejection channel C2*e*.

Thus, in the present embodiment, the following results compared to Comparative Example 1 in substantially the same manner as in Comparative Example 2. That is, the distance between the nozzle holes H1 adjacent to each other (and the distance between the nozzle holes H2 adjacent to each other) becomes longer compared to (Comparative Example 1) when the nozzle holes H1, H2 are each arranged in a row along the X-axis direction. Therefore, since the distance between the droplets which are jetted around the same time and flying toward the recording target medium (e.g., the recording paper P) increases, it is possible to relax the local concentration of the droplets flying between the nozzle holes H1, H2 and the recording target medium. Thus, in the present embodiment, the influence (the generation of the air current) on each of the droplets thus flying can be suppressed, and as a result, it is possible to suppress the occurrence of the wood-effect unevenness in concentration on the recording target medium described above compared to Comparative Example 1.

Further, in the present embodiment, since the whole of the plurality of ejection channels C1*e* (and the whole of the plurality of ejection channels C2*e*) is arranged inside the actuator plate 412 in a row along the X-axis direction in substantially the same manner as in Comparative Example 2. Thus, in the present embodiment, the existing structure is maintained in the whole of the plurality of ejection channels C1*e* (and the whole of the plurality of ejection channels C2*e*), and as a result, it becomes easy to form the ejection channels C1*e* (and the ejection channels C2*e*).

Further, in the present embodiment, unlike Comparative Example 2, the expansion flow channel parts 431, 432 described above are provided to the head chip 41. Specifically, the expansion flow channel part 431 for expanding the cross-sectional area (the flow channel cross-sectional area Sf3) of the flow channel of the ink 9 in the vicinity of the nozzle hole H11, H21 is formed in the vicinity of the nozzle hole H11, H21 (see FIG. 3). Further, the expansion flow channel part 432 for expanding the cross-sectional area (the flow channel cross-sectional area Sf4) of the flow channel of the ink 9 in the vicinity of the nozzle hole H12, H22 is formed in the vicinity of the nozzle hole H12, H22 (see FIG. 4).

Further, in the present embodiment, as described above, the central position Ph31 along the Y-axis direction in the expansion flow channel part 431 is shifted toward the first supply slit Sin1 along the Y-axis direction from the central position Pn11 of the nozzle hole H11 (see FIG. 7A). Similarly, the central position Ph31 along the Y-axis direction in the expansion flow channel part 431 is shifted toward the second supply slit along the Y-axis direction from the central position of the nozzle hole H21. Further, the central position Ph32 along the Y-axis direction in the expansion flow channel part 432 is shifted toward the first discharge slit Sout1 along the Y-axis direction from the central position Pn12 of the nozzle hole H12 (see FIG. 8A). Similarly, the central position Ph32 along the Y-axis direction in the expansion flow channel part 432 is shifted toward the second discharge slit along the Y-axis direction from the central position of the nozzle hole H22.

Since the expansion flow channel parts 431, 432 having such arrangement positions are respectively formed, in the present embodiment, the following results compared to Comparative Example 2. That is, such a difference in cross-sectional area Sfin1 of the first entrance side flow channel between the ejection channels C1*e*1 and the ejection channels C1*e*2 as described above decreases, and the pressure loss from the entrance side of the ink 9 to the nozzle holes H11, H12 described above also decreases. As a result, in the present embodiment, compared to Comparative Example 2, the difference in pressure in the steady state in the vicinity of the nozzle hole H11, H12 between the ejection channels C1*e*1 and the ejection channels C1*e*2 also decreases, and thus, the head value margin in the whole of the head chip 41 increases. Therefore, as a result, the ejection characteristics of the ink 9 in the inkjet head 4 are improved. It should be noted that such an action also occurs between the ejection channels C2*e* communicated with the respective nozzle holes H21 and the ejection channels C2*e* communicated with the respective nozzle holes H22 in substantially the same manner.

Incidentally, in contrast, in the case of Comparative Example 3 and Comparative Example 4 described above (see FIG. 7B) and FIG. 8B), since the arrangement positions of the expansion flow channel parts 301, 402 are different from those in the present embodiment described above, the following results. That is, in the Comparative Example 3, for example, as described above, the central position Ph31 along the Y-axis direction in the expansion flow channel part 301 is shifted in the opposite direction toward the first discharge slit Sout1 along the Y-axis direction from the central position Pn11 of the nozzle hole H11 (see FIG. 7B). Further, in the Comparative Example 4, for example, as described above, the central position Ph32 along the Y-axis direction in the expansion flow channel part 402 is shifted in the opposite direction toward the first supply slit Sin1 along the Y-axis direction from the central position Pn12 of the nozzle hole H12 (see FIG. 8B). Therefore, in Comparative Example 3 and Comparative Example 4, for example, the difference in pressure in the steady state in the vicinity of the nozzle hole H11, H12 between the ejection channels C1*e*1 and the ejection channels C1*e*2 becomes even larger, and the head value margin described above further decreases. Therefore, there is a possibility that the ejection characteristics of the ink 9 further degrade.

For the reason described above, in the present embodiment, it is possible to suppress the occurrence of the wood-effect unevenness in concentration on the recording target medium while making it easy to form the ejection channels C1*e*, C2*e*, and at the same time, it is possible to improve the ejection characteristics of the ink 9. Therefore, in the inkjet head 4 (the head chip 41) according to the present embodiment, it becomes possible to improve the print image quality while suppressing the manufacturing cost of the head chip 41 compared to Comparative Example 1 through Comparative Example 4 described above. Further, in the present embodiment, it also becomes possible to eject the ink 9 high in viscosity (high-viscosity ink).

Further, in particular in the present embodiment, since the expansion flow channel parts 431, 432 are configured so as to respectively include the opening parts H31, H32 (the opening parts for performing the alignment of each of the nozzle holes H1, H2) in the alignment plate 415, the following results. That is, it is possible to easily and accurately form the expansion flow channel parts 431, 432 using the existing opening parts H31, H32 in the alignment plate 415, respectively. Therefore, it becomes possible to further improve the ejection characteristics of the ink 9 to thereby further improve the print image quality while further suppressing the manufacturing cost of the head chip 41.

Further, in the present embodiment, since the both end parts along the Y-axis direction in the expansion flow channel parts 431, 432 (the opening parts H31, H32) are located on the inner side (in the pump chamber) of the both end parts along the Y-axis direction in the wall part W1 (or the wall part W2) (see FIG. 3 and FIG. 4), the following results. That is, the unevenness in the pressure characteristic decreases in, for example, the inside of the ejection channels C1*e*1, C1*e*2, and thus, the ejection characteristics of the ink 9 are further improved, and as a result, it becomes possible to further improve the print image quality.

Further, in the present embodiment, in the structure in which the nozzle holes H1 adjacent to each other (and the nozzle holes H2 adjacent to each other) along the X-axis direction are arranged so as to be shifted from each other along the Y-axis direction while maintaining the existing structure in the whole of the plurality of ejection channels C1*e* (and the whole of the plurality of ejection channels C2*e*) in such a manner as described above, it is also possible to achieve the following in substantially the same manner as in the existing structure. In other words, it is possible to uniform (commonalize) each of the first pump length Lw1 and the second pump length in all of the first slit pairs Sp1 and all of the second slit pairs. Thus, in the present embodiment, a variation in the ejection characteristics between the nozzle holes H1 adjacent to each other (and the nozzle holes H2 adjacent to each other) can be suppressed, and as a result, it becomes possible to further improve the print image quality. Further, in the present embodiment, the following results compared to when arranging the first supply slits Sin1 and the second supply slits in a zigzag manner along the X-axis direction, and arranging the first discharge slits Sout1 and the second discharge slits in a zigzag manner along the X-axis direction. That is, first, in such a case, the whole of the plurality of ejection channels C1*e* (and the whole of the plurality of ejection channels C2*e*) is also arranged in a zigzag manner along the X-axis direction. In contrast, in the present embodiment, since it is possible to form (process) the whole of the plurality of ejection channels C1*e* (and the whole of the plurality of ejection channels C2*e*) without adopting the zigzag arrangement in substantially the same manner as the existing structure (see FIG. 5), the workability of the head chip 41 becomes good (it becomes possible to process the head chip 41 while maintaining the existing manufacturing process). Thus, in the present embodiment, it also becomes possible to realize to make the manufacturing process of the head chip 41 easy.

Further, in the present embodiment, since the flow channel widths (the first entrance side flow channel width Win1 and the second entrance side flow channel width) in the entrance side common flow channels Rin1, Rin2, and the flow channel widths (the first exit side flow channel width Wout1 and the second exit side flow channel width) in the exit side common flow channels Rout1, Rout2 are each made constant along the extending direction (the X-axis direction) of each of the common flow channels, the following results. In other words, regarding the structure of each of the entrance side common flow channels Rin1, Rin2 and the exit side common flow channels Rout1, Rout2, it becomes possible to maintain the existing structure.

In addition, in the present embodiment, since the one side along the extending direction (the Y-axis direction) in each of the dummy channels C1*d*, C2*d* forms the side surface described above, and at the same time, the other side along the extending direction thereof opens up to the end part along the Y-axis direction of the actuator plate 412, the following results. That is, as described above, in the structure in which the nozzle holes H1 adjacent to each other (and the nozzle holes H2 adjacent to each other) along the X-axis direction are arranged so as to be shifted from each other along the Y-axis direction, it becomes possible to arrange the nozzle holes H1, H2 in the nozzle plate 411 at high density without changing the overall size (the chip size) of the head chip 41. Further, since the other side described above in each of the dummy channels C1*d*, C2*d* opens up to the end part described above, it becomes possible to form the individual electrodes Eda to individually be disposed in the dummy channels C1*d*, C2*d* separately (in the state of being electrically isolated) from the common electrodes Edc to be disposed in the ejection channels C1*e*, C2*e*. For the reason described above, in the present embodiment, it becomes possible to realize to make the manufacturing process of the head chip 41 easy while achieving the reduction in chip size in the head chip 41.

2. Modified Examples

Then, some modified examples (Modified Example 1 through Modified Example 4) of the embodiment described above will be described. It should be noted that the same constituents as those in the embodiment are denoted by the same reference symbols, and the description thereof will arbitrarily be omitted.

Modified Example 1

(Configuration)

Figures 13A, 13B, 13C:
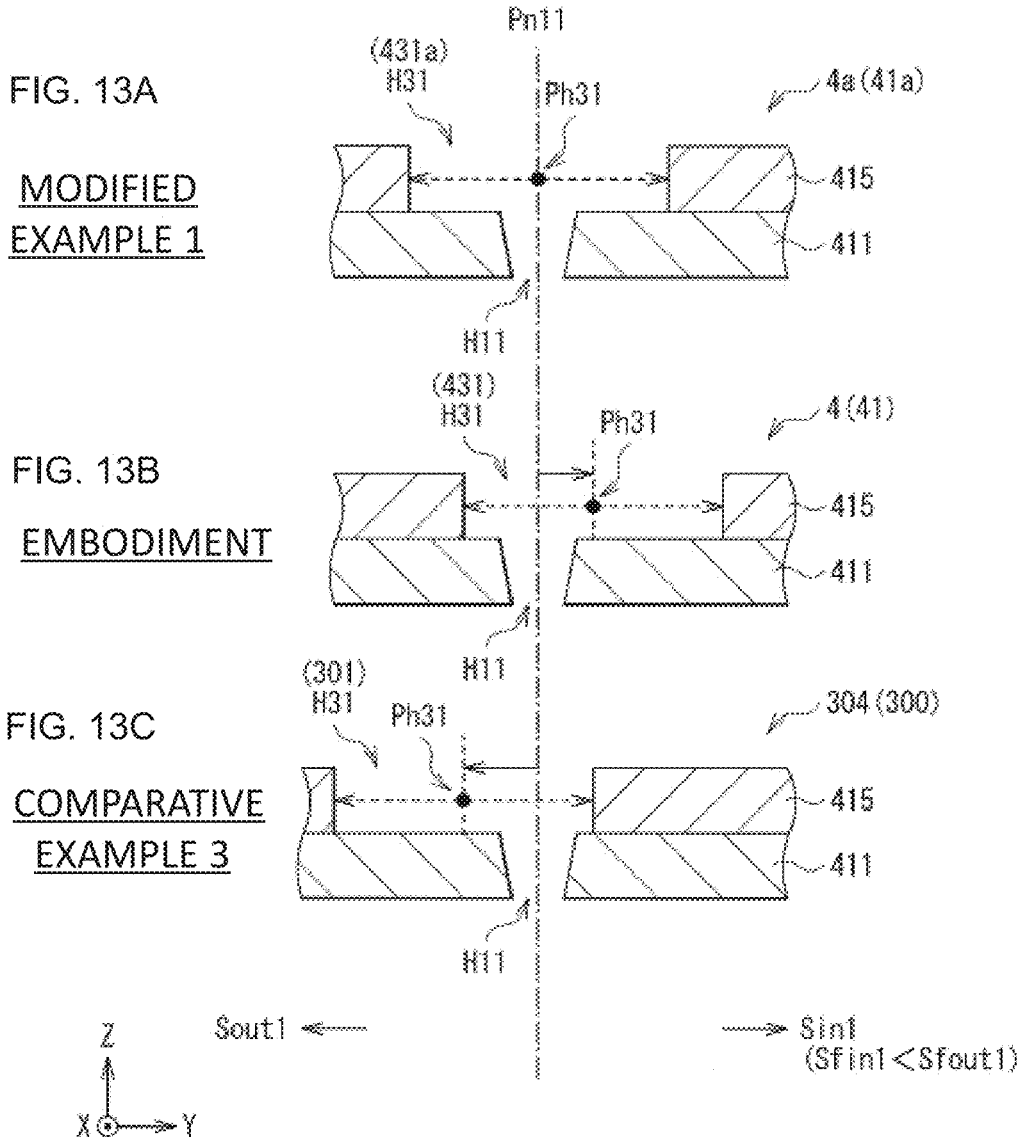
Figure 14A:
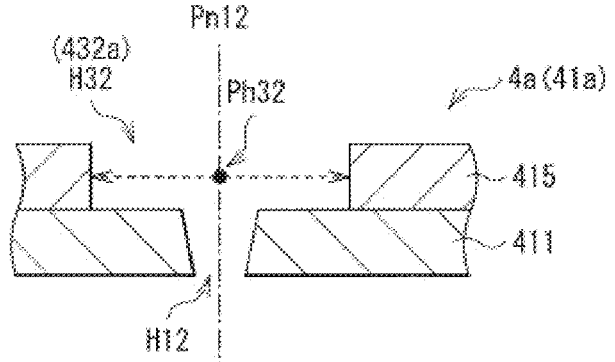
Figure 14B:
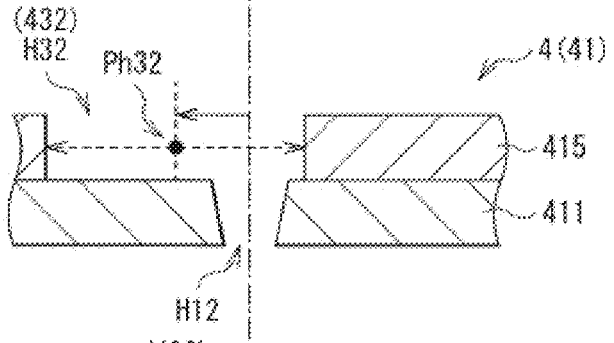
Figure 14C:
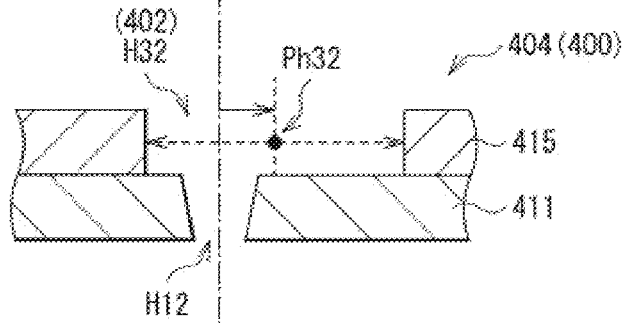
Figure 14C:
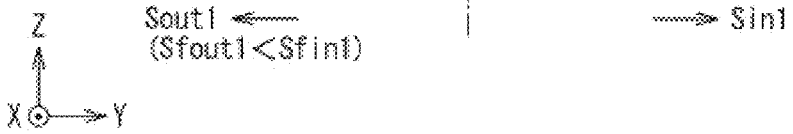

FIGS. 13A-13C and FIGS. 14A-14C are each a cross-sectional view (a Y-Z cross-sectional view) schematically showing an example of a positional relationship between the nozzle holes H1, H2 and the expansion flow channel part related to Modified Example 1 and so on. Specifically, FIG. 13A is a diagram showing a cross-sectional configuration of an expansion flow channel part 431*a* and so on in an inkjet head 4*a* (a head chip 41*a*) according to Modified Example 1. FIG. 13B and FIG. 13C are diagrams showing the cross-sectional configurations (the cross-sectional configurations shown in FIG. 7A and FIG. 7B described above) in the expansion flow channel part 431 and so on in the embodiment described above and the expansion flow channel part 301 and so on in Comparative Example 3, respectively, in contrast with each other. Further, FIG. 14A is a diagram showing a cross-sectional configuration of an expansion flow channel part 432*a* and so on in the inkjet head 4*a* (the head chip 41*a*) according to Modified Example 1. FIG. 14B and FIG. 14C are diagrams showing the cross-sectional configurations (the cross-sectional configurations shown in FIG. 8A and FIG. 8B described above) in the expansion flow channel part 432 in the embodiment described above and the expansion flow channel part 402 in Comparative Example 4, respectively, in contrast with each other.

As shown in FIG. 13A and FIG. 14A, the inkjet head 4*a* according to Modified Example 1 corresponds to what is provided with the head chip 41*a* instead of the head chip 41 in the inkjet head 4 according to the embodiment. It should be noted that such an inkjet head 4*a* corresponds to a specific example of the "liquid jet head" in the present disclosure.

In the head chip 41*a*, expansion flow channel parts 431*a*, 432*a* described below are formed instead of the expansion flow channel parts 431, 432 in the head chip 41, respectively (see FIG. 13A and FIG. 14A).

It should be noted that such an expansion flow channel part 431*a* corresponds to a specific example of the "first expansion flow channel part" in the present disclosure. Similarly, the expansion flow channel part 432*a* corresponds to a specific example of the "second expansion flow channel part" in the present disclosure.

As shown in FIG. 13A, the central position Ph31 along the Y-axis direction in the expansion flow channel part 431*a* coincides with the central position Pn11 of the nozzle hole H11. Similarly, the central position Ph31 along the Y-axis direction in the expansion flow channel part 431*a* coincides with the central position of the nozzle hole H21.

Further, as shown in FIG. 14A, the central position Ph32 along the Y-axis direction in the expansion flow channel part 432*a* coincides with the central position Pn12 of the nozzle hole H12. Similarly, the central position Ph32 along the Y-axis direction in the expansion flow channel part 432*a* coincides with the central position of the nozzle hole H22.

(Functions/Advantages)

Also in the inkjet head chip 4*a* (the head chip 41*a*) according to Modified Example 1 having such a configuration, it is possible to obtain basically the same advantages due to substantially the same function as that of the inkjet head 4 (the head chip 41) according to the embodiment.

Specifically, in Modified Example 1, unlike the embodiment, as described above, the central position Ph31 along the Y-axis direction in the expansion flow channel part 431*a* coincides with each of the central position Pn11 of the nozzle hole H11 and the central position of the nozzle hole H21. Similarly, as described above, the central position Ph32 along the Y-axis direction in the expansion flow channel part 432*a* coincides with each of the central position Pn12 of the nozzle hole H12 and the central position of the nozzle hole H22. Also in Modified Example 1 described above, due to substantially the same action as in the embodiment described above, the head value margin in the whole of the head chip 41*a* increases, and as a result, the ejection characteristics of the ink 9 in the inkjet head 4*a* are improved. Therefore, also in Modified Example 1, similarly to the embodiment, it becomes possible to improve the print image quality while suppressing the manufacturing cost of the head chip 41*a*.

Figure 15A:
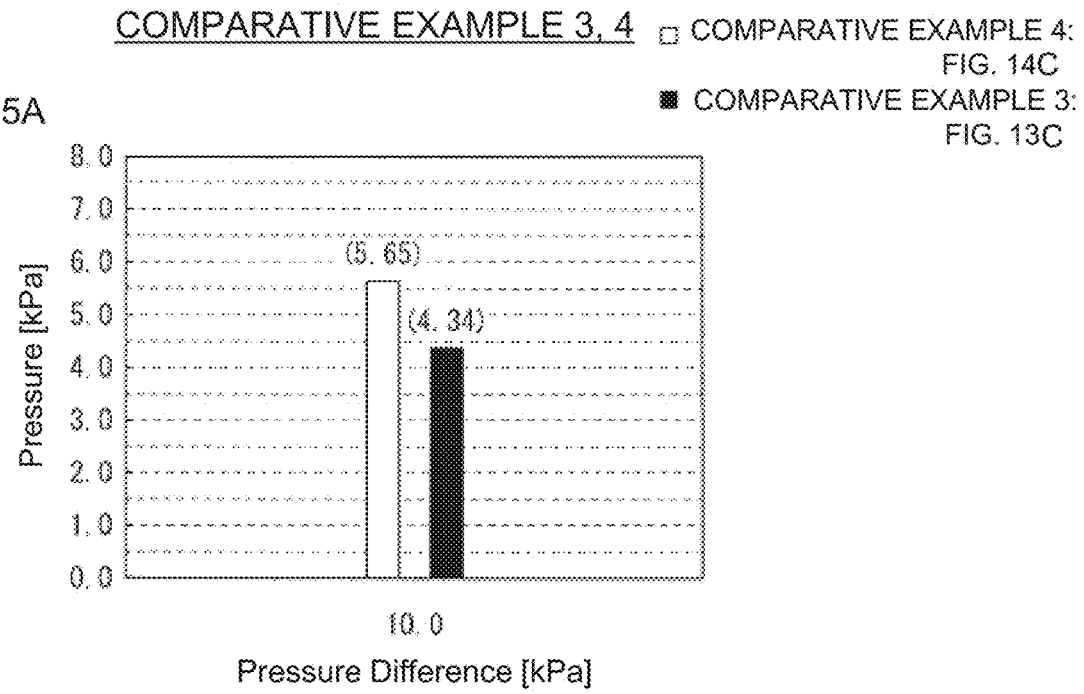
FIGS. 15A and 15B are diagrams showing an example of a simulation result related to Comparative Example 3, Comparative Example 4, and Modified Example 1.
Figure 15B:
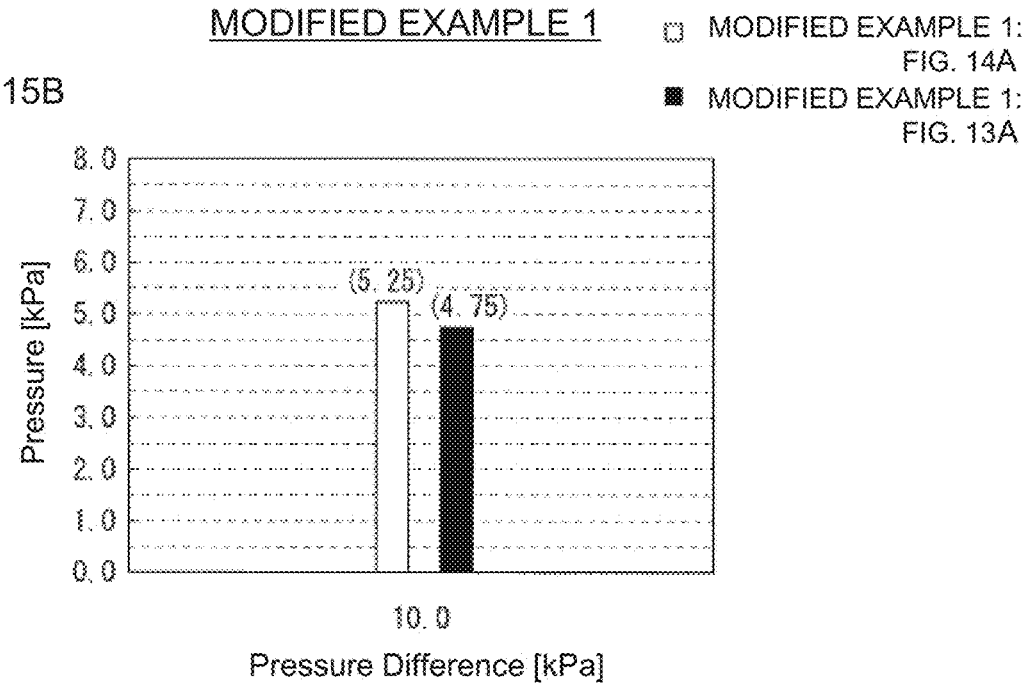

Here, FIGS. 15A and 15B are diagrams showing an example of a simulation result related to Modified Example 1 described above, and Comparative Example 3 and Comparative Example 4 described above. Specifically, FIG. 15A shows a simulation result of the pressure in the vicinity of the nozzle hole H1, H2 related to Comparative Example 3 and Comparative Example 4 with respect to the pressure value (see Modified Example 3: FIG. 13C) in the vicinity of the nozzle hole H11, H21 and the pressure value (see Modified Example 4: FIG. 14C) in the vicinity of the nozzle hole H12, H22. Further, FIG. 15B shows a simulation result of the pressure in the vicinity of the nozzle hole H1, H2 related to Modified Example 1 with respect to the pressure value (see FIG. 13A) in the vicinity of the nozzle hole H11, H21 and the pressure value (see FIG. 14A) in the vicinity of the nozzle hole H12, H22. It should be noted that in either of the examples shown in FIG. 15A and FIG. 15B, there is shown when (a pressure difference)=10.0 [kPa] is assumed.

It should be noted that in Comparative Example 3, Comparative Example 4, and Modified Example 1, shift amounts in the zigzag arrangement in each of the nozzle holes H1, H2 and the expansion flow channel parts 301, 402 are assumed as (+0.25 mm, −0.25 mm).

When comparing Comparative Example 3 and Comparative Example 4 with Modified Example 1, the pressure value in the vicinity of the nozzle hole H11, H21 described above and the pressure value in the vicinity of the nozzle hole H12, H22 in Comparative Example 3 and Comparative Example 4 become as follows. That is, it is understood that in Comparative Example 3 and Comparative Example 4 having the configuration described above, the pressure difference described above increases to a value more than double compared to Modified Example 1 having the configuration described above. As described above, it is understood that in Comparative Example 3 and Comparative Example 4, the pressure difference in the steady state in the vicinity of the nozzle hole H11, H12 between the ejection channels C1*e*1 and the ejection channels C1*e*2 has increased on the contrary compared to that in Modified Example 1. In such a manner, from this simulation result, it can be said that there is a possibility that in Comparative Example 3 and Comparative Example 4, the head value margin described above further decreases due to the increase in pressure difference described above, and as a result, the ejection characteristics of the ink 9 degrade.

Comparative Example 3, Comparative Example 4: (the pressure difference described above)=(5.65−4.34)=1.28 [kPa]

Modified Example 1: (the pressure difference described above)=(5.25−4.75)=0.50 [kPa]

Modified Example 2

(Configuration)

Figure 16:
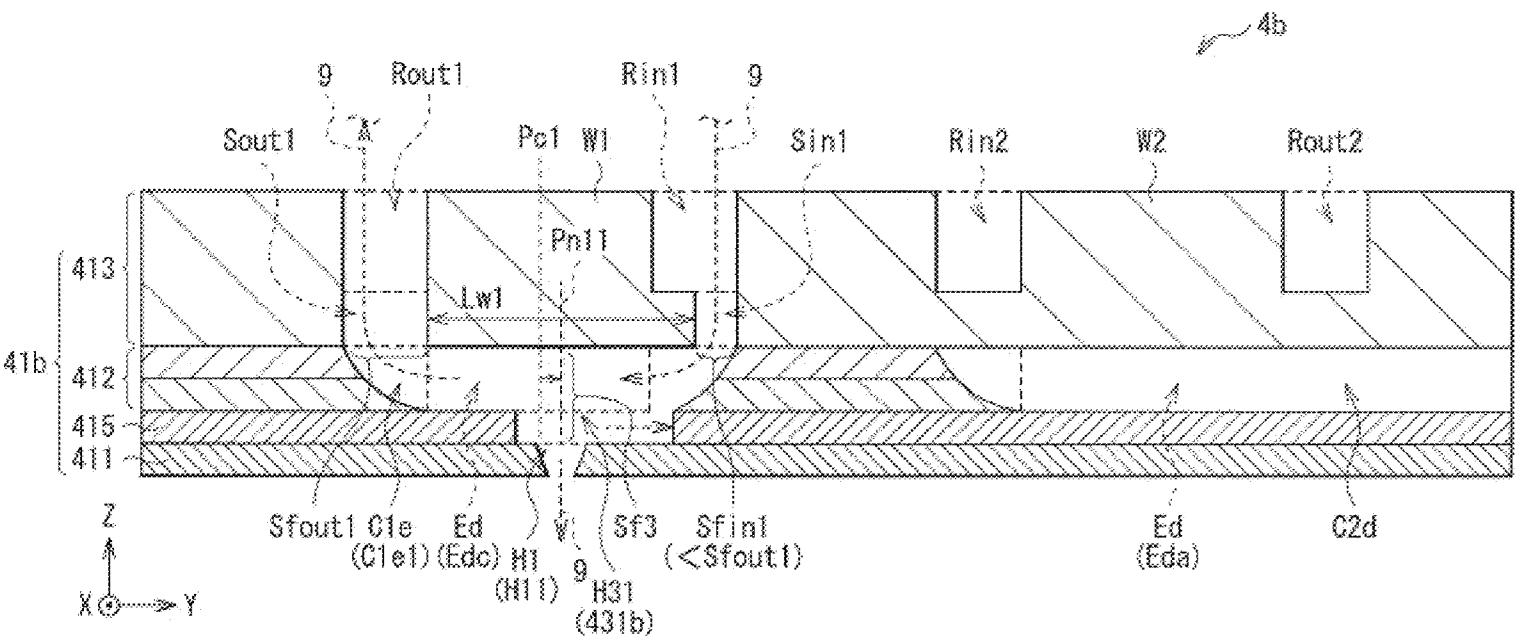
FIG. 16 is a schematic diagram showing a cross-sectional configuration example in a liquid jet head according to Modified Example 2.
Figure 17:
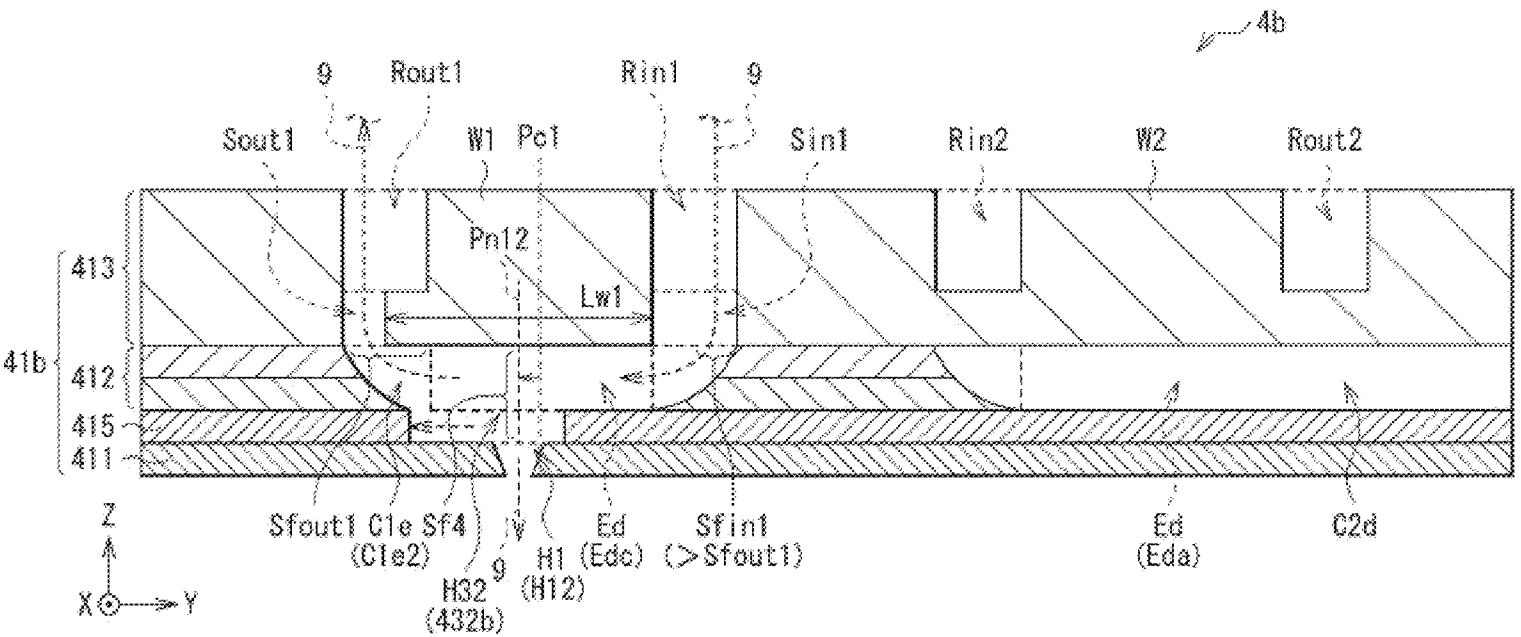
FIG. 17 is a schematic diagram showing another cross-sectional configuration example in the liquid jet head according to Modified Example 2.

FIG. 16 and FIG. 17 are each a diagram schematically showing a cross-sectional configuration example (a Y-Z cross-sectional configuration example) of an inkjet head 4*b* according to Modified Example 2. Specifically, FIG. 16 shows the cross-sectional configuration example corresponding to a part including the nozzle hole H11 (the ejection channel C1*e*1) in the inkjet head 4*b* according to Modified Example 2, and corresponds to FIG. 3 in the embodiment. Further, FIG. 17 shows the cross-sectional configuration example corresponding to a part including the nozzle hole H12 (the ejection channel C1*e*2) in the inkjet head 4*b* according to Modified Example 2, and corresponds to FIG. 4 in the embodiment.

As shown in FIG. 16 and FIG. 17, the inkjet head 4*b* according to Modified Example 2 corresponds to what is provided with a head chip 41*b* instead of the head chip 41 in the inkjet head 4 (see FIG. 3 and FIG. 4) according to the embodiment. It should be noted that such an inkjet head 4*b* corresponds to a specific example of the "liquid jet head" in the present disclosure.

In the head chip 41*b*, expansion flow channel parts 431*b*, 432*b* described below are formed instead of the expansion flow channel parts 431, 432 in the head chip 41, respectively (see FIG. 16 and FIG. 17).

It should be noted that such an expansion flow channel part 431*b* corresponds to a specific example of the "first expansion flow channel part" in the present disclosure. Similarly, the expansion flow channel part 432*b* corresponds to a specific example of the "second expansion flow channel part" in the present disclosure.

In these expansion flow channel parts 431*b*, 432*b*, unlike the expansion flow channel parts 431, 432, one end part along the Y-axis direction in the expansion flow channel parts 431*b*, 432*b* (the opening parts H31, H32) expands to the outside of the pump chamber described above.

Specifically, as shown in FIG. 16, defining the end part on the first supply slit Sin1 side in the wall part W1 as a reference position, the end part on the first supply slit Sin1 side in the expansion flow channel part 431*b* is disposed on the first supply slit Sin1 side of the reference position. Similarly, defining the end part on the second supply slit side in the wall part W2 as a reference position, the end part on the second supply slit side in the expansion flow channel part 431*b* is disposed on the second supply slit side of the reference position. It should be noted that the end part on the first discharge slit Sout1 side and the end part on the second discharge slit side in the expansion flow channel part 431*b* are both located inside the pump chamber described above similarly to the expansion flow channel part 431 described in the embodiment.

Further, as shown in FIG. 17, defining the end part on the first discharge slit Sout1 side in the wall part W1 as a reference position, the end part on the first discharge slit Sout1 side in the expansion flow channel part 432*b* is disposed on the first discharge slit Sout1 side of the reference position. Similarly, defining the end part on the second discharge slit side in the wall part W2 as a reference position, the end part on the second discharge slit side in the expansion flow channel part 432*b* is disposed on the second discharge slit side of the reference position. It should be noted that the end part on the first supply slit Sin1 side and the end part on the second supply slit side in the expansion flow channel part 432*b* are both located inside the pump chamber described above similarly to the expansion flow channel part 432 described in the embodiment.

(Functions/Advantages)

Also in the inkjet head 4*b* (the head chip 41*b*) according to Modified Example 2 having such a configuration, it is possible to obtain basically the same advantages due to substantially the same function as that of the inkjet head 4 (the head chip 41) according to the embodiment.

Further, in particular in Modified Example 2, as described above, since one end part along the Y-axis direction in the expansion flow channel parts 431*b*, 432*b* (the opening parts H31, H32) expands to the outside of the pump chamber described above, the following results. That is, such a difference in cross-sectional area Sfin1 of the first entrance side flow channel between the ejection channels C1*e*1 and the ejection channels C1*e*2 as described above further decreases, and the pressure loss from the entrance side of the ink 9 to the nozzle holes H11, H12 described above also decreases to a lower level. As a result, in Modified Example 2, the head value margin in the whole of the head chip 41*b* further increases, and as a result, the ejection characteristics of the ink 9 in the inkjet head 4*b* are further improved. Therefore, in Modified Example 2, it becomes possible to further improve the print image quality.

Modified Example 3

(Configuration)

Figure 18:
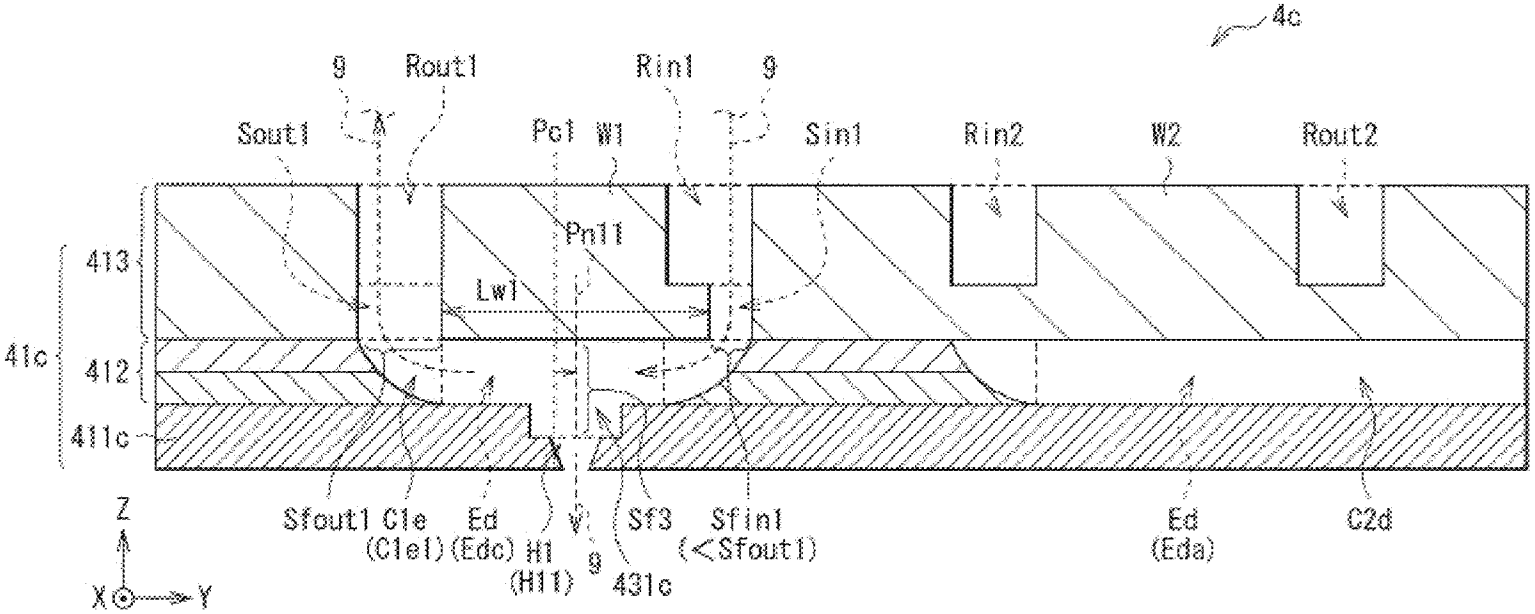
FIG. 18 is a schematic diagram showing a cross-sectional configuration example in a liquid jet head according to Modified Example 3.
Figure 19:
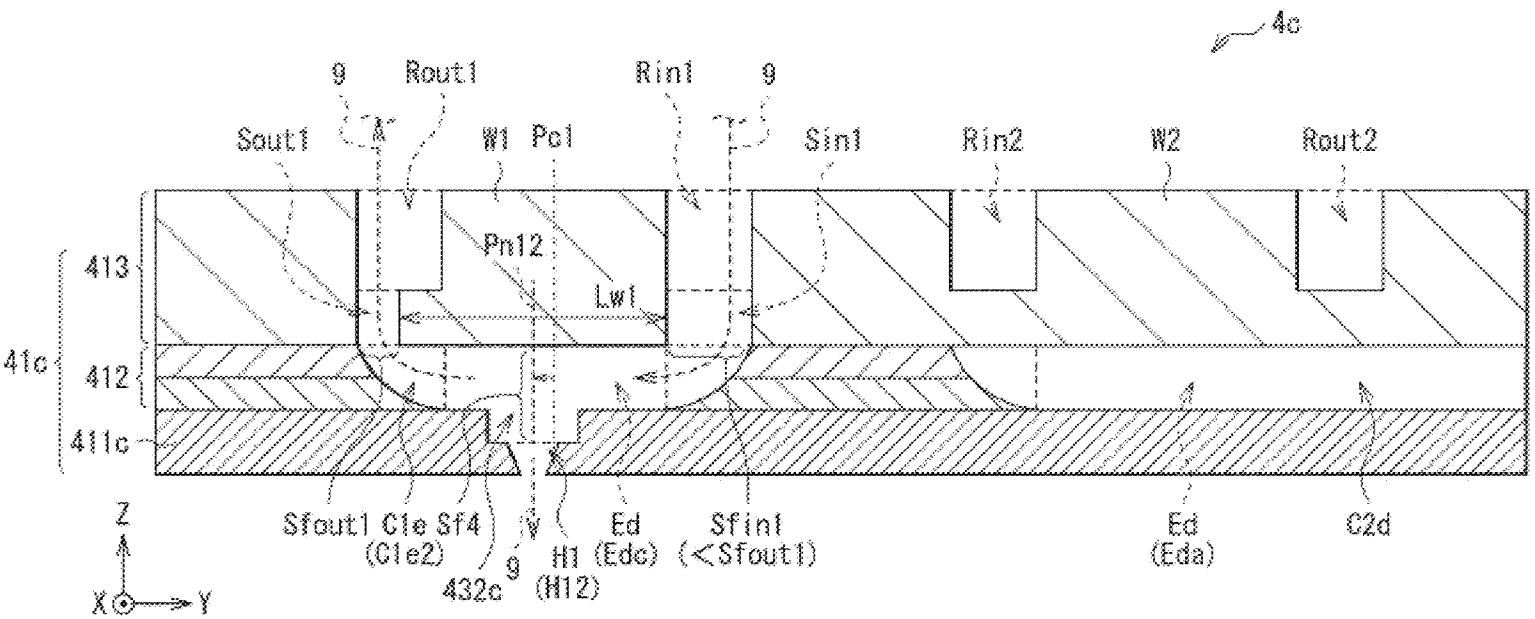
FIG. 19 is a schematic diagram showing another cross-sectional configuration example in the liquid jet head according to Modified Example 3.

FIG. 18 and FIG. 19 are each a diagram schematically showing a cross-sectional configuration example (a Y-Z cross-sectional configuration example) of an inkjet head 4*c* according to Modified Example 3. Specifically, FIG. 18 shows the cross-sectional configuration example corresponding to a part including the nozzle hole H11 (the ejection channel C1*e*1) in the inkjet head 4*c* according to Modified Example 3, and corresponds to FIG. 3 in the embodiment. Further, FIG. 19 shows the cross-sectional configuration example corresponding to a part including the nozzle hole H12 (the ejection channel C1*e*2) in the inkjet head 4*c* according to Modified Example 3, and corresponds to FIG. 4 in the embodiment.

As shown in FIG. 18 and FIG. 19, the inkjet head 4*c* according to Modified Example 3 corresponds to what is provided with the head chip 41*c* instead of the head chip 41 in the inkjet head 4 (see FIG. 3 and FIG. 4) according to the embodiment. Further, the head chip 41*c* according to Modified Example 3 corresponds to what is obtained by eliminating the alignment plate 415, and at the same time, providing a nozzle plate 411*c* described below instead of the nozzle plate 411 in the head chip 41, and the rest of the configuration is made basically the same. It should be noted that such an inkjet head 4*c* corresponds to a specific example of the "liquid jet head" in the present disclosure.

Such a nozzle plate 411*c* is provided with expansion flow channel parts 431*c*, 432*c* having substantially the same functions as those of the expansion flow channel parts 431, 432 described in the embodiment (see FIG. 18 and FIG. 19). Specifically, the expansion flow channel part 431*c* for expanding the cross-sectional area (the flow channel cross-sectional area Sf3) of the flow channel of the ink 9 in the vicinity of the nozzle hole H11, H21 is formed in the vicinity of the nozzle hole H11, H21 in the nozzle plate 411*c* (see FIG. 18). Further, the expansion flow channel part 432*c* for expanding the cross-sectional area (the flow channel cross-sectional area Sf4) of the flow channel of the ink 9 in the vicinity of the nozzle hole H12, H22 is formed in the vicinity of the nozzle hole H12, H22 in the nozzle plate 411*c* (see FIG. 19).

As described above, while in the head chip 41 according to the embodiment, both of the expansion flow channel parts 431, 432 are configured so as to include the opening parts H31, H32 in the alignment plate 415, respectively, in the head chip 41*c* according to Modified Example 3, both of the expansion flow channel parts 431*c*, 432*c* are provided to the nozzle plate 411*c*. Incidentally, such expansion flow channel parts 431*c*, 432*c* are each formed of a step-like (two-step structure) opening structure communicated with the nozzle hole H11, H12, H21, and H22 on the nozzle plate 411*c* (see FIG. 18 and FIG. 19).

It should be noted that such an expansion flow channel part 431*c* corresponds to a specific example of the "first expansion flow channel part" in the present disclosure. Similarly, the expansion flow channel part 432*c* corresponds to a specific example of the "second expansion flow channel part" in the present disclosure.

(Functions/Advantages)

Also in the inkjet head 4*c* (the head chip 41*c*) according to Modified Example 3 having such a configuration, it is possible to obtain basically the same advantages due to substantially the same function as that of the inkjet head 4 (the head chip 41) according to the embodiment.

Further, in particular in Modified Example 3, as described above, since the expansion flow channel parts 431*c*, 432*c* are both provided to the nozzle plate 411*c*, it becomes possible to form the expansion flow channel parts 431*c*, 432*c* by processing the existing member (the nozzle plate). Therefore, in Modified Example 3, it becomes possible to further suppress the manufacturing cost of the head chip 41*c*.

It should be noted that also in Modified Example 3, similarly to Modified Example 2 described above, it is possible to arrange that one end part along the Y-axis direction in the expansion flow channel parts 431*c*, 432*c* expands to the outside of the pump chamber described above.

Modified Example 4

(Configuration)

Figure 20:
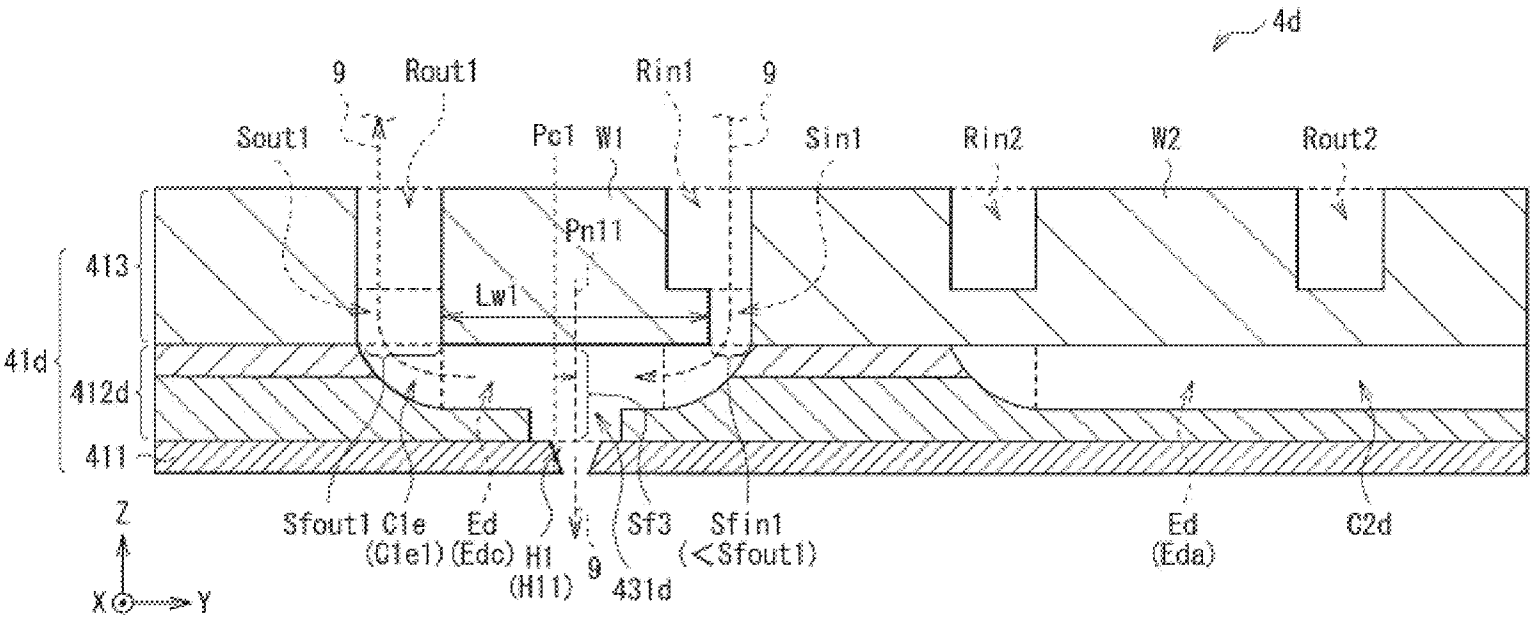
FIG. 20 is a schematic diagram showing a cross-sectional configuration example in a liquid jet head according to Modified Example 4.
Figure 21:
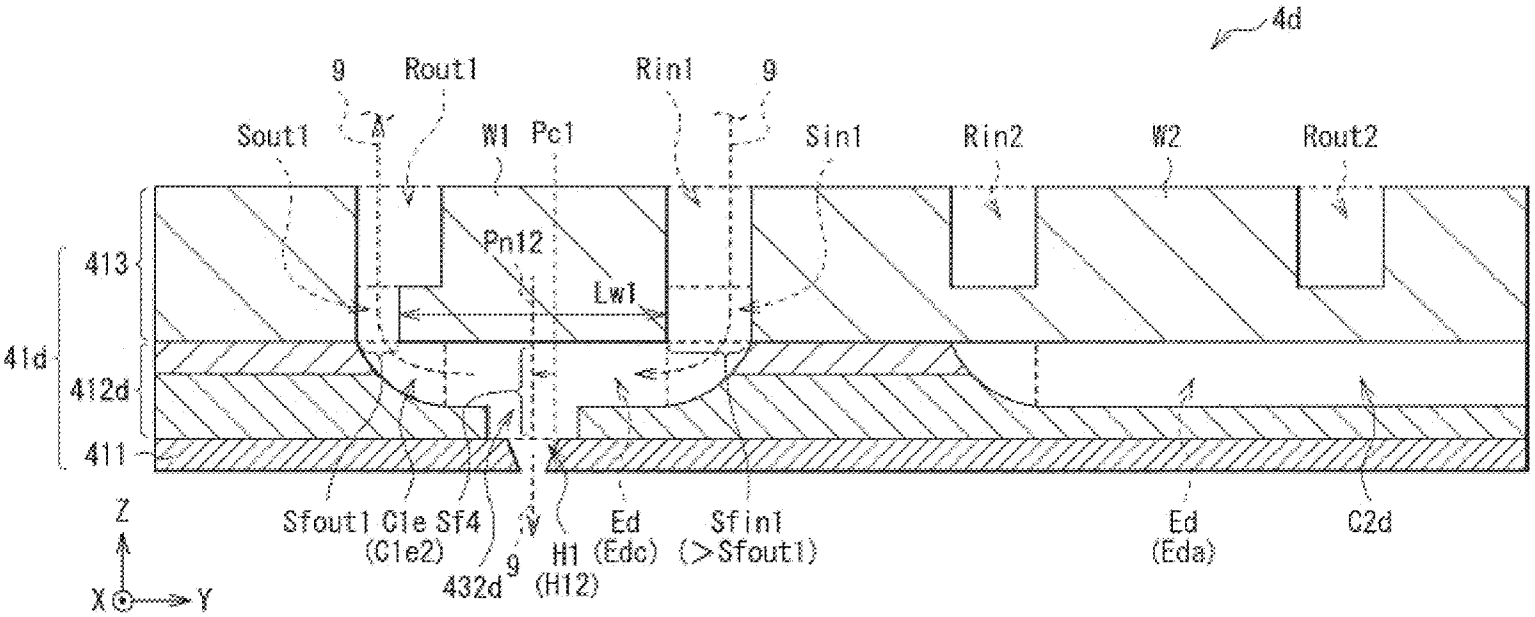
FIG. 21 is a schematic diagram showing another cross-sectional configuration example in the liquid jet head according to Modified Example 4.

FIG. 20 and FIG. 21 are each a diagram schematically showing a cross-sectional configuration example (a Y-Z cross-sectional configuration example) of an inkjet head 4*d* according to Modified Example 4. Specifically, FIG. 20 shows the cross-sectional configuration example corresponding to a part including the nozzle hole H11 (the ejection channel C1*e*1) in the inkjet head 4*d* according to Modified Example 4, and corresponds to FIG. 3 in the embodiment. Further, FIG. 21 shows the cross-sectional configuration example corresponding to a part including the nozzle hole H12 (the ejection channel C1*e*2) in the inkjet head 4*d* according to Modified Example 4, and corresponds to FIG. 4 in the embodiment.

As shown in FIG. 20 and FIG. 21, the inkjet head 4*d* according to Modified Example 4 corresponds to what is provided with the head chip 41*d* instead of the head chip 41 in the inkjet head 4 (see FIG. 3 and FIG. 4) according to the embodiment. Further, the head chip 41*d* according to Modified Example 4 corresponds to what is obtained by eliminating the alignment plate 415, and at the same time, providing an actuator plate 412*d* described below instead of the actuator plate 412 in the head chip 41, and the rest of the configuration is made basically the same. It should be noted that such an inkjet head 4*d* corresponds to a specific example of the "liquid jet head" in the present disclosure.

Such an actuator plate 412*d* is provided with expansion flow channel parts 431*d*, 432*d* having substantially the same functions as those of the expansion flow channel parts 431, 432 described in the embodiment (see FIG. 20 and FIG. 21). Specifically, the expansion flow channel part 431*d* for expanding the cross-sectional area (the flow channel cross-sectional area Sf3) of the flow channel of the ink 9 in the vicinity of the nozzle hole H11, H21 is formed in the vicinity of the nozzle hole H11, H21 in the actuator plate 412*d* (see FIG. 20). Further, the expansion flow channel part 432*d* for expanding the cross-sectional area (the flow channel cross-sectional area Sf4) of the flow channel of the ink 9 in the vicinity of the nozzle hole H12, H22 is formed in the vicinity of the nozzle hole H12, H22 in the actuator plate 412*d* (see FIG. 21).

As described above, while in the head chip 41 according to the embodiment, both of the expansion flow channel parts 431, 432 are configured so as to include the opening parts H31, H32 in the alignment plate 415, respectively, in the head chip 41*d* according to Modified Example 4, both of the expansion flow channel parts 431*d*, 432*d* are provided to the actuator plate 412*d*. Incidentally, such expansion flow channel parts 431*d*, 432*d* are each formed of a step-like (two-step structure) opening structure communicated with the nozzle hole H11, H12, H21, and H22 on the actuator plate 412*d* (see FIG. 20 and FIG. 21).

It should be noted that such an expansion flow channel part 431*d* corresponds to a specific example of the "first expansion flow channel part" in the present disclosure. Similarly, the expansion flow channel part 432*d* corresponds to a specific example of the "second expansion flow channel part" in the present disclosure.

(Functions/Advantages)

Also in the inkjet head 4*d* (the head chip 41*d*) according to Modified Example 4 having such a configuration, it is possible to obtain basically the same advantages due to substantially the same function as that of the inkjet head 4 (the head chip 41) according to the embodiment.

Further, in particular in Modified Example 4, as described above, since the expansion flow channel parts 431*d*, 432*d* are both provided to the actuator plate 412*d*, it becomes possible to form the expansion flow channel parts 431*d*, 432*d* by processing the existing member (the actuator plate). Therefore, in Modified Example 4, it becomes possible to further suppress the manufacturing cost of the head chip 41*d*.

It should be noted that also in Modified Example 4, similarly to Modified Example 2 described above, it is possible to arrange that one end part along the Y-axis direction in the expansion flow channel parts 431*d*, 432*d* expands to the outside of the pump chamber described above.

3. Other Modified Examples

The present disclosure is described hereinabove citing the embodiment and the modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer and the inkjet head, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment and so on described above, the description is presented citing the inkjet head 4 of the two-row type (having the two nozzle arrays An1, An2), but the example is not a limitation. Specifically, for example, it is also possible to adopt an inkjet head of a single-row type (having a single nozzle array), or an inkjet head of a multi-row type (having three or more nozzle arrays) with three or more rows (e.g., three rows or four rows).

Further, although in the embodiment and so on described above, there are specifically described the example (the example of the zigzag arrangement) of the shifted arrangement of the nozzle holes H1 (H11, H12), H2 (H21, H22), the configuration example of a variety of plates (the nozzle plate, the actuator plate, the cover plate, and the alignment plate), and so on, these examples are not a limitation. Specifically, other configuration examples can be adopted as the shifted arrangement of the nozzle holes and the configuration of a variety of plates.

Further, in the embodiment and so on described above, the description is presented citing when the ejection channels (the ejection grooves) and the dummy channels (the non-ejection grooves) each extend along the Y-axis direction (a direction perpendicular to the direction in which the channels are arranged side by side) in the actuator plate as an example, but this example is not a limitation. Specifically, it is also possible to arrange that, for example, the ejection channels and the dummy channels extend along an oblique direction (a direction forming an angle with each of the X-axis direction and the Y-axis direction) in the actuator plate.

Further, for example, the cross-sectional shape of each of the nozzle holes H1, H2 is not limited to the circular shape as described in the above embodiment and so on, but can also be, for example, an elliptical shape, a polygonal shape such as a triangular shape, or a star shape. Further, the cross-sectional shape of each of the ejection channels C1*e*, C2*e* and the dummy channels C1*d*, C2*d* is described citing when being formed by the cutting work by the dicer to thereby have the side surface shaped like an arc (a curved surface) in the embodiment and so on described above as an example, but this example is not a limitation. Specifically, for example, it is possible to arrange that the cross-sectional shape of each of the ejection channels C1*e*, C2*e* and the dummy channels C1*d*, C2*d* becomes a variety of side surface shapes other than the arc-like shape by forming the channels using other processing method (e.g., etching or blast processing) than such cutting work with a dicer.

In addition, in the embodiment and so on described above, the description is presented citing the circulation type inkjet head for using the ink 9 while circulating the ink 9 between the ink tank and the inkjet head as an example, but the example is not a limitation. Specifically, in some cases, for example, it is also possible to apply the present disclosure to a non-circulation type inkjet head using the ink 9 without circulating the ink 9.

Further, as the structure of the inkjet head, it is possible to apply those of a variety of types. In other words, for example, in the embodiment and so on described above, the description is presented citing as an example a so-called side-shoot type inkjet head for ejecting the ink 9 from a central part in the extending direction of each of the ejection channels in the actuator plate. It should be noted that this example is not a limitation, but it is possible to apply the present disclosure to an inkjet head of another type.

Further, the type of the printer is not limited to the type described in the embodiment and so on described above, and it is possible to apply a variety of types such as an MEMS (Micro Electro-Mechanical Systems) type.

Further, the series of processes described in the above embodiment and so on can be arranged to be performed by hardware (a circuit), or can also be arranged to be performed by software (a program). When arranging that the series of processes is performed by the software, the software is constituted by a program group for making the computer perform the functions. The programs can be incorporated in advance in the computer described above and are then used, or can also be installed in the computer described above from a network or a recording medium and are then used.

Further, in the above embodiment and so on, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1> A head chip configured to jet a liquid comprising: an actuator plate having a plurality of ejection grooves arranged side by side along a predetermined direction; a nozzle plate having a plurality of nozzle holes individually communicated with the plurality of ejection grooves; and a cover plate having a first through hole configured to make the liquid inflow into the ejection groove, a second through hole configured to make the liquid outflow from the ejection groove, and a wall part configured to cover the ejection groove, wherein the plurality of nozzle holes includes a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove, in a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, in a second ejection groove as the ejection groove communicated with the second nozzle hole, the second cross-sectional area is smaller than the first cross-sectional area, a first expansion flow channel part configured to increase a third cross-sectional area as a cross-sectional area of a flow channel of the liquid in a vicinity of the first nozzle hole is formed in the vicinity of the first nozzle hole, a second expansion flow channel part configured to increase a fourth cross-sectional area as a cross-sectional area of a flow channel of the liquid in a vicinity of the second nozzle hole is formed in the vicinity of the second nozzle hole, a central position along the extending direction of the ejection groove in the first expansion flow channel part coincides with a first central position as a central position of the first nozzle hole, or is shifted toward the first through hole along the extending direction of the ejection groove from the first central position, and a central position along the extending direction of the ejection groove in the second expansion flow channel part coincides with a second central position as a central position of the second nozzle hole, or is shifted toward the second through hole along the extending direction of the ejection groove from the second central position.

<2> The head chip according to <1>, further comprising: an alignment plate which is disposed between the actuator plate and the nozzle plate, and has a third through hole for performing alignment of the nozzle hole respective to each of the nozzle holes, wherein the first expansion flow channel part and the second expansion flow channel part are each configured to include the third through hole in the alignment plate.

<3> The head chip according to <1>, wherein the first expansion flow channel part and the second expansion flow channel part are each provided to the nozzle plate.

<4> The head chip according to <1>, wherein the first expansion flow channel part and the second expansion flow channel part are each provided to the actuator plate.

<5> The head chip according to any one of <1> to <4>, wherein defining an end part on the first through hole side in the wall part as a reference position, an end part on the first through hole side in the first expansion flow channel part is located on the second through hole side of the reference position, and defining an end part on the second through hole side in the wall part as a reference position, an end part on the second through hole side in the second expansion flow channel part is located on the first through hole side of the reference position.

<6> The head chip according to any one of <1> to <4>, wherein defining an end part on the first through hole side in the wall part as a reference position, an end part on the first through hole side in the first expansion flow channel part is located on the first through hole side of the reference position, and defining an end part on the second through hole side in the wall part as a reference position, an end part on the second through hole side in the second expansion flow channel part is located on the second through hole side of the reference position.

<7> A liquid jet head comprising the head chip according to any one of <1> to <6>.

<8> A liquid jet recording device comprising the liquid jet head according to <7>.

What is claimed is:

1. A head chip configured to jet a liquid comprising:

an actuator plate having a plurality of ejection grooves arranged side by side along a predetermined direction;

a nozzle plate having a plurality of nozzle holes individually communicated with the plurality of ejection grooves; and a cover plate having a first through hole configured to make the liquid inflow into the ejection groove, a second through hole configured to make the liquid outflow from the ejection groove, and a wall part configured to cover the ejection groove, wherein the plurality of nozzle holes includes:

a plurality of first nozzle holes disposed so as to be shifted toward the first through hole along an extending direction of the ejection groove with reference to a central position along the extending direction of the ejection groove, and a plurality of second nozzle holes disposed so as to be shifted toward the second through hole along the extending direction of the ejection groove with reference to a central position along the extending direction of the ejection groove, in a first ejection groove as the ejection groove communicated with the first nozzle hole, a first cross-sectional area as a cross-sectional area of a flow channel of the liquid in a part communicated with the first through hole is smaller than a second cross-sectional area as a cross-sectional area of a flow channel of the liquid in a part communicated with the second through hole, in a second ejection groove as the ejection groove communicated with the second nozzle hole, the second cross-sectional area is smaller than the first cross-sectional area, a first expansion flow channel part configured to increase a third cross-sectional area as a cross-sectional area of a flow channel of the liquid in a vicinity of the first nozzle hole is formed in the vicinity of the first nozzle hole, a second expansion flow channel part configured to increase a fourth cross-sectional area as a cross-sectional area of a flow channel of the liquid in a vicinity of the second nozzle hole is formed in the vicinity of the second nozzle hole, a central position along the extending direction of the ejection groove in the first expansion flow channel part coincides with a first central position as a central position of the first nozzle hole, or is shifted toward the first through hole along the extending direction of the ejection groove from the first central position, and a central position along the extending direction of the ejection groove in the second expansion flow channel part coincides with a second central position as a central position of the second nozzle hole, or is shifted toward the second through hole along the extending direction of the ejection groove from the second central position.

2. The head chip according to claim 1, further comprising:

an alignment plate which is disposed between the actuator plate and the nozzle plate, and has a third through hole for performing alignment of the nozzle hole respective to each of the nozzle holes, wherein the first expansion flow channel part and the second expansion flow channel part are each configured to include the third through hole in the alignment plate.

3. The head chip according to claim 1, wherein:

the first expansion flow channel part and the second expansion flow channel part are each provided to the nozzle plate.

4. The head chip according to claim 1, wherein:

the first expansion flow channel part and the second expansion flow channel part are each provided to the actuator plate.

5. The head chip according to claim 1, wherein:

defining an end part on the first through hole side in the wall part as a reference position, an end part on the first through hole side in the first expansion flow channel part is located on the second through hole side of the reference position, and defining an end part on the second through hole side in the wall part as a reference position, an end part on the second through hole side in the second expansion flow channel part is located on the first through hole side of the reference position.

6. The head chip according to claim 1, wherein:

defining an end part on the first through hole side in the wall part as a reference position, an end part on the first through hole side in the first expansion flow channel part is located on the first through hole side of the reference position, and defining an end part on the second through hole side in the wall part as a reference position, an end part on the second through hole side in the second expansion flow channel part is located on the second through hole side of the reference position.

7. A liquid jet head comprising the head chip according to claim 1.

8. A liquid jet recording device comprising the liquid jet head according to claim 7.

* * * * *